US006860092B2

(12) United States Patent
Collida et al.

(10) Patent No.: US 6,860,092 B2
(45) Date of Patent: Mar. 1, 2005

(54) FIBER STUFFING AND FLUFFING MACHINE

(76) Inventors: Karl Collida, 81 Elaine Dr., Ofallon, MO (US) 63366; Edwin T. Wood, Jr., 81 Elaine Dr., Ofallon, MO (US) 63366

( * ) Notice: Subject to any disclaimer, the term of this patent is extended or adjusted under 35 U.S.C. 154(b) by 0 days.

(21) Appl. No.: 10/398,247

(22) PCT Filed: Feb. 3, 2003

(86) PCT No.: PCT/US03/03072

§ 371 (c)(1),
(2), (4) Date: Feb. 3, 2003

(65) Prior Publication Data

US 2004/0040264 A1 Mar. 4, 2004

Related U.S. Application Data

(60) Provisional application No. 60/354,261, filed on Feb. 4, 2002.

(51) Int. Cl.[7] ..... B65B 63/02
(52) U.S. Cl. ..... 53/521; 53/527; 53/530
(58) Field of Search ..... 53/521, 527, 530; 141/67

(56) References Cited

U.S. PATENT DOCUMENTS 829,738 A * 8/1906 Robinson ..... 141/67
3,351,106 A * 11/1967 Moulthrop ..... 141/67
3,693,836 A * 9/1972 Eisner ..... 406/99
4,664,160 A * 5/1987 Rothstein et al. ..... 141/67
5,060,351 A * 10/1991 Street ..... 28/283
2002/0009948 A1 * 1/2002 Woods ..... 446/369

* cited by examiner

*Primary Examiner*—Stephen F. Gerrity
*Assistant Examiner*—Hemant M Desai
(74) *Attorney, Agent, or Firm*—Kevin L. Klug

(57) ABSTRACT

A fiber stuffing and fluffing machine utilized for fiber stuffing toys, pillows, and other skins having a venturi vacuum system, a unique agitation cavity and blade arrangement, and various unique mechanical and electrical features which provide improved stuffing and fluffing capabilities over the prior art. The art of the present invention is capable of integration into a single stand alone unit which performs improved fluffing and stuffing operations without the need for external pneumatic sources. The art of the present invention, in its various embodiments, also utilizes scroll compressors or turbine compressors heretofore not found in prior art stuffing and fluffing applications. The present art further provides means for separating foreign objects from the ingested stuffing fibers to protect the fluffer blower.

42 Claims, 32 Drawing Sheets

Vented Foreign Object Catch located at the Plenum Bottom. It is designed to catch any heavy objects put into the Fluffer's material inlet and protect the Fluffer's Rotating Blower from any damage.

NOTES:
1. THE SCHEMATIC SHOWN REPRESENTS A FLUFFER THAT IS BUILT TO FEED THREE STUFFERS
2. THE SELECTOR SWITCH AND SOLENOID VALVES ARE NOT INSTALLED ON FLUFFERS THAT ARE BUILT TO ONLY FEED A SINGLE STUFFER
3. A TWO POSITION SELECTOR SWITCH AND ONLY TWO SOLENOID VALVES ARE INSTALLED ON FLUFFERS THAT ARE BUILT TO FEED TWO STUFFERS

FIBER STUFFING AND FLUFFING MACHINE

This application claims priority of U.S. Provisional Patent Application No. 60/354,261, filed Feb. 4, 2002.

BACKGROUND OF THE INVENTION

The present invention relates in general to stuffing machines and more particularly to a unique fiber stuffing and fluffing machine capable of stuffing pillows, stuffed toys, and other devices, collectively called skins, which comprises unique features not found in the prior art. The present art device utilizes a venturi vacuum system in conjunction with an electric foot switch and air actuated switch and is further fed by a fluffing machine with a unique blast gate valve arrangement. The present art stuffing and fluffing machines are designed in a manner which allows them to be integrated into a single machine along with a compact pneumatic supply.

Traditionally stuffing machines comprise at a minimum an output stuffing nozzle tube and an agitation cavity fed by a fiber fluffing machine or picker. Stuffing fibers exit said cavity through a stuffing nozzle. Onto the exiting end of the stuffing nozzle is placed the article to be fiber filled such as the aforesaid toys, pillows, etc. The agitation cavity contains an agitator which keeps the stuffing fibers fluffed and further randomly feeds said fibers to the output stuffing nozzle. Traditionally, the output stuffing nozzle utilizes a compressed air stream to force fibers out of the machine when they randomly fall into a gap where said stream flows and operates. This traditional approach relies upon fibers randomly entering the air stream gap due to the agitation effect of the agitator. Inevitably, this traditional approach results in fiber buildup and clogging around the air stream gap, thereby creating a void within said air stream gap. That is, since the fibers must enter the air stream gap in order to be "blown" out of the nozzle, any fibers which buildup and cover but do not enter the air stream gap have no exiting force acting upon them. Said air stream gap is traditionally a gap or opening in the stuffing nozzle tube located within said agitation cavity. The prior art stuffing nozzle tube has compressed air blown therethrough and across the gap which exits external to the cavity, thereby transporting stuffing fiber along with the air stream. Once the fiber buildup covers the air stream gap, fiber is prohibited from entering the gap and therefore cannot exit the stuffing nozzle.

The present invention utilizes a stuffing nozzle venturi system in conjunction with unique control and feeding methods which ensure that a vacuum or negative pressure exists at the portion of the stuffing nozzle within the agitation cavity. That is, instead of placing an air flow stream across the air stream gap, the present invention places a venturi within the stuffing nozzle and effectively suctions the stuffing fibers from the agitation cavity. Since a negative pressure exists where the fibers enter the stuffing nozzle, the stuffing fibers are not able to easily buildup or clog. Any fibers which are agitatively placed near the entering portion of the stuffing nozzle, i.e. the venturi entrance, are suctioned into the stuffing nozzle and thereafter into the venturi entrance throat. The venturi exiting throat contains the compressed air stream which feeds the venturi. Thus, any fiber which enters the venturi entrance throat is suctioned through the venturi and then blown out of the venturi exiting throat by the compressed air which feeds the venturi. The compressed air venturi feed further serves to inflate the article at the exiting portion of the stuffing nozzle, thereby forming a cavity into which is deposited the stuffing fiber suctioned from the agitation cavity. Use of the aforementioned venturi system eliminates the need for an air stream gap but will nevertheless function with systems having an air stream gap.

The invention first comprises a stuffing machine (stuffer) having a stuffing nozzle, an agitation cavity having access doors and a filtered exhaust vent, rotating or moving agitator blades within said cavity, a venturi within said stuffing nozzle, along with the unique control and switching systems described herein. The invention also comprises a fluffing machine (fluffer) which operates in conjunction with said stuffer to blow and fluff stuffing fibers through a duct or pipe into the agitation cavity of said stuffer. Said fluffer comprises a blower mounted within a housing which is fed stuffing fibers through a plenum along with the unique control and switching systems described herein. The fluffer serves to expand or fluff the compressed fibers prior to entrance within the agitation cavity. The present invention presumes availability of a compressed air source and in a preferred embodiment incorporates said source within the fluffer/stuffer combination unit.

Another unique aspect of the present stuffer invention in conjunction with the machine control as a whole is the orientation of the agitator blades with respect to the entrance portion of the stuffing nozzle. That is, in the preferred embodiment, the rotational axis of the agitator is placed perpendicular to the entrance portion of the stuffing nozzle. This allows the agitator blades to sweep closely past said entrance portion and act to clean and remove fibers from the entrance. Prior art stuffing machines place the stuffing nozzle in parallel with the agitator axis of rotation, thereby foregoing the beneficial effect of agitator blade fiber removal.

Accordingly, it is an object of the present invention to provide an improved fiber stuffing and fluffing machine which provides stand alone fiber fluffing and stuffing operations and is highly resistant to nozzle clogging.

Another object of the present invention is to provide an improved fiber stuffing and fluffing machine which is capable of operation with a single power source for both the stuffing and fluffing components.

A further object of the present invention is to provide an improved fiber stuffing and fluffing machine which utilizes a unique blast gate which is highly resistant to clogging and fiber buildup.

A still further object of the present invention is to provide an improved fiber stuffing and fluffing machine which contains its own self contained pneumatic source which provides a minimum of noise and oil discharge.

A still further object of the present invention is to provide an improved fiber stuffing and fluffing machine which minimizes static buildup within the agitation cavity.

A yet further object of the present invention is to provide an improved fiber stuffing and fluffing machine which has display and auditory features capable of enticing and interesting potential users.

SUMMARY OF THE INVENTION

To accomplish the foregoing and other objects of this invention there is provided an improved fiber stuffing and fluffing machine for use in stuffing pillows, stuffed toys, and other devices which comprises unique features not found in the prior art. The apparatus in a preferred embodiment comprises a stuffing machine having a stuffing nozzle, agitation cavity, control system, pressurized air supply, and activation switches and a fluffing machine having a housing and blower, plenum, and blast gate valve. All of the aforementioned uniquely formed and combined to provide the useful features herein described. An embodiment of the present art combines the stuffing machine, fluffing machine, and a compressed air source into a single stand alone machine.

The invention first comprises a stuffing machine (stuffer) having a stuffing nozzle, an agitation cavity having access doors and a filtered exhaust vent, rotating or moving agitator blades within said cavity, a venturi within said stuffing nozzle, along with the unique control and switching systems described herein. The invention also comprises a fluffing machine (fluffer) which operates in conjunction with said stuffer to blow stuffing fibers through a duct or pipe into the agitation cavity of said stuffer. Said fluffer comprises a blower mounted within a housing which is fed stuffing fibers through a plenum along with the unique control and switching systems described herein. The fluffer serves to expand or fluff the compressed fibers prior to entrance within the agitation cavity.

The present invention presumes availability of a compressed air source. In the preferred embodiment, said air source is a uniquely compact air source heretofore not utilized for the present application and also integrally mounted within the stuffing machine. The preferred compact air source is a scroll compressor, heretofore utilized primarily outside of the present art. Said scroll compressor provides superior benefits for the present application. That is, it provides high pressure and high volume airflow in a compact package with a limited noise output. Another preferred compact air source is a turbine compressor, heretofore not utilized in the present art. The turbine compressor provides the desired high volume airflow in a compact package with a limited noise output, yet has a limited pressure output which requires the feed orifices within the aforementioned venturi be larger to accommodate the lower pressure. Traditionally a piston or screw type compressor is used with the present art.

The present invention utilizes a stuffing nozzle venturi system in conjunction with unique control and feeding methods which ensure that a vacuum or negative pressure exists at the portion of the stuffing nozzle within the agitation cavity. That is, instead of placing an air flow stream across the air stream gap, the present invention places a venturi within the stuffing nozzle and effectively suctions the stuffing fibers from the agitation cavity. Since a negative pressure exists where the fibers enter the stuffing nozzle, the stuffing fibers are not able to easily buildup. Any fibers which are agitatively placed near the entering portion of the stuffing nozzle, i.e. the venturi entrance, are suctioned into the stuffing nozzle and thereafter into the venturi entrance throat. The venturi exiting throat contains the compressed air stream which feeds the venturi. Thus, any fiber which enters the venturi entrance throat is suctioned through the venturi and then blown out of the venturi exiting throat by the compressed air which feeds the venturi. The compressed air venturi feed further serves to inflate the article at the exiting portion of the stuffing nozzle, thereby forming a cavity into which is deposited the stuffing fiber suctioned from the agitation cavity. Use of the aforementioned venturi system eliminates the need for an air stream gap but will nevertheless function with systems having an air stream gap.

Another aspect of the present stuffer invention in conjunction with the machine control as a whole is the orientation of the agitator blades with respect to the entrance portion of the stuffing nozzle. That is, in the preferred embodiment, the rotational axis of the agitator is placed perpendicular to the entrance portion of the stuffing nozzle. This allows the agitator blades to sweep closely past said entrance portion and act to clean and remove fibers from the entrance. Prior art stuffing machines place the stuffing nozzle in parallel with the agitator axis of rotation, thereby foregoing the beneficial effect of agitator blade fiber removal. For alternative embodiments with more than one nozzle, the agitator blades which sweep each nozzle entrance may be offset over a plurality of angles relative to each other and to the axis of rotation. For example, the blades for a left nozzle may be positioned 90 degrees offset from the blades for the right nozzle. This provides a mixing or flip-flop effect for the stuffing fibers within the cavity.

A feature of the present invention in conjunction with the machine control as a whole is the utilization of an interlocked air pressurization system. That is, in a preferred embodiment, air pressurization to the venturi system ceases when the agitator drive system is turned off or a stuffing machine door is opened for servicing or filling. This is accomplished by safety switches located in each door interrupting the energizing current to a normally closed electrically actuated air valve. The air valve is in series with the pressurized air supply for the venturi. A display mode is also provided which disables the venturi system. Through utilization of a display mode switch, the venturi and its air valve are disabled yet the stuffing machine continues agitating the fibers within the cavity and also provides lighting and sound effects.

A unique feature of the present invention is the use of a hand actuated switch. Traditionally, the operation of a stuffing machine has been via a foot actuated pneumatic valve. This prior art format limits use of the stuffing machine by handicapped persons who cannot use their lower extremities. An embodiment of the present art utilizes an extendable squeeze bulb at hand level which pneumatically actuates an electric switch which in turn then energizes and opens an electropneumatic valve to activate venturi operation. The electropneumatic valve is normally closed but when actuated allows compressed air to flow into and through the venturi. The aforementioned squeeze bulb hand actuated switch further provides an added margin of safety to the machine. That is, since it is a pneumatic switch the user is electrically isolated from the system. The invention also uses an electrical foot switch in parallel with said squeeze bulb switch which performs the aforementioned via foot movement action without extending pneumatic lines to said foot switch.

A still further improvement over the prior art is presented in the present art's system for controlling static buildup on the stuffing fibers. Since the stuffing fibers represent an insulating material with a low surface electron bonding energy, electrons are easily stripped from the fibers, thereby charging them more positively. This fiber charging phenomena causes the fibers to electrostatically adhere to surfaces within the agitation cavity. This is especially true since the interior surface of the agitation cavity is often painted and acts as an insulator. An embodiment of the present art incorporates a conductive paint which coats the interior surface of the agitation cavity and allows excess charge to be bled onto or away from the surface of said cavity. The surface of the cavity is typically grounded to an earth ground. A further embodiment, incorporates an ionized air shower within the agitation cavity. The ionizers are commercially available components that mount within a compressed air flow line and negatively ionize the air flowing therethrough. Typically said ionizers operate with conventional 110 or 220 volt AC power but may be designed to operate on any AC or DC power source. A still further embodiment incorporates the use of an anti-static mat within the agitation cavity. This mat is held to earth ground and helps neutralize the positively charged fibers within the agitation cavity.

In an effort to further eliminate nozzle clogging, one unique embodiment of the present art includes a pulsed pneumatic feed to the venturi. This is accomplished via actuation of a pulsed timing circuit in series with the electropneumatic venturi valve which provides a typically one to five hertz electric pulse actuation of the electropneumatic venturi valve. The pulsed timing circuit is actuated with a pulsed timing switch in a preferred embodiment but may actuate automatically or continuously in alternative embodiments. The pneumatic pulsing allows the agitator blades to remove any accumulated fibers from the entrance mouth of the nozzle without negative venturi pressure holding said fibers in place and yet retain an air flow within the venturi nozzle for any remnant fibers within said nozzle. Said pulse timing circuit is simply a low frequency oscillator which generates electrical driving pulses to an electropneumatic valve. The frequency of said pulses may deviate from said one to five hertz in alternative embodiments. That is, the frequency may be so low as to only pulse the venturi air flow off occasionally or pulse the venturi air flow off and on at hundreds or thousands of hertz.

Further included within an embodiment of the present invention is an exiting nozzle which is mounted upon an extension hose. This extension hose/nozzle combination allows the fiber stuffable item to be located apart from the vicinity of the agitation cavity exiting nozzle. The art of the present invention further allows mounting of more than one stuffing nozzle onto a machine with a single agitator. Alternative embodiments utilize a swivel nozzle design fed by said extension hose which allows the operator to move the nozzle to a convenient position. In this embodiment, typically said nozzle is connected with the cavity via said hose with said venturi positioned within said hose or nozzle. Further embodiments utilize the swivel nozzle without utilizing the extension hose.

Use of a venturi at the exiting end of an extension hose also allows removal and stuffing of fibers or other material from an overhead holding receptacle. That is, if stuffing fibers or filling material are held in an overhead hopper, gravity hose feeding will allow the venturi to suction and direct said material under pressure to a receptacle.

The present art stuffing machine further utilizes an air filter at the exhaust vent within the agitation cavity. That is, prior art stuffing machines utilized a screen or vented holes at the exhaust vent which allowed small fibers to escape to atmosphere when the pressurized air flow of the fluffer fed the agitation cavity. The present art places an air filter, such as those commercially available for heating and air conditioning applications, over the exhaust vent to prevent escape of small fiber material. Typically said exhaust vent and filter are located near the topmost portion of the agitation cavity.

Typically used with the aforesaid stuffing machine is a fluffer machine which is often called a picker within the prior art. The fluffer takes compressed fiber stuffing material, fluffs it or agitates it, and then blows it into the stuffing machine agitation cavity through a pipe or flexible hose. The fluffer typically comprises a rotating blower mounted within a housing which provides the fluffing agitation and pressurization necessary to blow the fiber into the stuffing machine. Prior art stuffing machines typically each have a dedicated fluffing machine located apart from the stuffer. Furthermore, prior art fluffing machines are susceptible to damage from foreign objects within the fiber stuffing material which flow therethrough. That is, prior art fluffing machines have no method or mechanism to filter out harmful foreign objects within the fiber stuff material. Still further, prior art fluffing machines emit uncomfortable levels of noise.

The present invention overcomes the aforementioned prior art problems by first incorporating one or more unique diverting blast gate valves at its output which allows switching among multiple stuffing machines connected to a single fluffer. That is, when a stuffing machine requires filling by the fluffer, a blast gate valve may be openly positioned to direct the flow to the desired stuffing machine and thereafter fill the agitation cavity with the desired amount of stuffing fiber. In a preferred embodiment, the blast gate valve is pneumatically opened and closed. Alternative embodiments may utilize manual, hydraulic, or electrical control. Furthermore, the prior art noise problem is alleviated by placing sound absorbing foam material within the fluffer housing, especially near the blower and blower motor.

The present invention also overcomes the aforementioned prior art problems by providing an embodiment having an integrated stuffer and fluffer combination. That is, an embodiment of the present art places the stuffer and fluffer into a single stand alone machine also having an integrated air supply and operating from a single power source. Due to the technical difficulties of integrating all of the aforementioned components, the prior art has yet to provide said integration. The stand alone unit of the present art allows for sound isolation, ease of setup, ease of use, and foreign object separation, all within one package. An alternate embodiment of the integrated stuffer-fluffer may utilize the blast gate valve to feed stuffing material to a separate and stand alone stuffing machine, thereby eliminating the need for another stand alone fluffer. Furthermore, the duct or pipe between the fluffer and stuffer may be diverted external to the machine and manufactured of a clear material, whether integrated or stand alone, to allow visualization of the fiber flow between the fluffing and stuffing machines.

The unique blast gate valve design of the present art incorporates novel features which minimize buildup and clogging within said valve. Blast gate valves typically have circular entrance and exiting ports into which feeding and exiting pipes are placed and further have a reduced diameter circular mid-section between said pipes which is substantially the same diameter as the interior diameter of said pipes. Typically the pipes are of a PVC material. Prior art blast gate valve designs utilize a manually operated blade which seats into a groove or slot when closed. The present art utilizes a pneumatically operated blade, with a unique pneumatic cylinder and alignment coupler system, which does not mate into a groove or slot. That is, the prior art blast gate valve seating grooves or slots allow stuffing fibers to build up into said slots when the blast gate closes. Continued use of the prior art valve design creates more fiber buildup which prohibits the valve from completely closing. Within the present art, the blast gate blade is perfectly shaped to seat against a half circular seat which follows the contours of the blast gate mid-section. The seat is flush in a substantially half circle radius with the circular outline of the circular mid-section whereby fibers cannot be trapped. The aforementioned foreign object ingestion problem is eliminated in an embodiment of the present art via the use of a feed separation plenum at the entrance to the fluffer. The feed separation plenum may have various forms and may function with a stand alone fluffer or an integrated fluffer-stuffer combination. The plenum fiber exiting opening is connected via piping or hoses with the fluffer entrance. Foreign objects of higher density than the stuffing fiber are more affected by gravitational pull within the plenum cavity than the suction of the fluffer. Thus stuffing fiber is pulled into the fluffer while foreign objects of higher density fall to the base of the plenum cavity, thereby protecting the fluffer from damage. In a preferred embodiment said plenum is visually clear or translucent to allow for monitoring of the fiber intake.

An alternative embodiment of the fluffer further utilizes a deflector system or deflector plate at the output of the fluffer blower to partially recirculate stuffing fibers through a duct or pipe into the entrance or intake of the fluffer blower or to restrict output fiber flow whereby fibers are retained for a longer period within said fluffer blower. Since the integrated fluffer is positioned on or with said stuffer, the length of duct or piping between the fluffer and stuffer is minimal. This reduced length tends to limit the turbulent mixing of the fluffed fibers and the surrounding air flow. Thus, by recirculating a portion of the stuffing fibers with the deflector plate deflecting the fibers back into the entrance, intake, or impeller of the fluffer, greater fluffing and/or shredding of the fibers is achieved. The deflector plate and/or associate ducting is useful for both integrated and non-integrated fluffing machines.

Alternative embodiments of the present art further incorporate integrated sound such as recorded music or unique noises or sounds which are played in response to a user input. Such inputs include but are not limited to button pressing, motion detector sensing, pressure mat sensing, conductive sensor sensing of a user, or radio frequency identification of user's radio frequency identification tag. The integrated sound is enable via an on board computer or electronic circuit connected with said sensors and which have the music or sound stored within and further drives connected speakers. Thus, when the aforementioned sensors activate, the computer or microcircuit is triggered to play the unique sound, thereby making the stuffing experience more enticing and interesting.

Further alternative embodiments of the present art incorporate one or more colored lighting sources to illuminate the agitation cavity or the machine as a whole. Since the stuffing fiber material which is typically utilized with the present art is of a bright white color, colored lighting shining onto the fibers tends to impart the lighting hue or color to the fiber. This colored effect produces a glowing of the agitating fibers which is attractive and pleasant to the user, thereby enticing the user to utilize the stuffing machine. The colored lighting is automatically sequenced by electronic circuitry of the machine or may be triggered by the same type sensors as described for the aforementioned sound effects. The lighting may be enabled with a plurality of technologies including but not limited to incandescent, flourescent, neon, or light emitting diode sources. The lighting may also utilize gels or colored filters between the light source and the light target to provide further control of the impinging hue.

Further alternative embodiments utilize a scrolling text or panel display mounted with or onto the machine. The display may provide rolling messages for the user such as "happy birthday" or a company name when activated. The display may also provide animations, cartoons, or customer information to further encourage use of the machine. The aforesaid may be embodied in the form of a computer or video display machine which drives the display and is activated with the aforementioned sensors or automatically due to a user input or machine energizing or sequencing.

Still further alternative embodiments utilize one or more electronic cameras mounted onto the machine to capture customer images. Said images may be displayed upon the aforesaid displays or printed to capture the moment. The electronic camera functions are enabled via use of a computer or electronic circuit interfaced with said electronic cameras and said display or an attached printer. Thus, customers are further encouraged to use the machine by the ability of the machine to capture the moment of toy stuffing.

In summary, the art of the present invention comprises in one or more of its forms a unique stuffing machine having an agitation cavity, a motor operated agitator, two or more agitator blades, one or more stuffing nozzles communicating externally from said cavity, a pneumatically operated venturi within said stuffing nozzle, an air bulb switch and electrical foot switch for actuation of said venturi, a fluffing machine having a blower and blower motor, a fluffer plenum attached to its input, a static control system and the other aforementioned features.

The fluffer and stuffer may utilize electrical power of different potentials, single or three phase, without departing from the scope and spirit of the present invention, provided the motors, valves, and contactors are sized and specified for such power. Furthermore, the schematic representations provided herewith may be substantially altered and yet provide the same external functions described.

The aforedescribed stuffing machine along with its fluffer and feed plenum may be manufactured from a variety of materials which are capable of withstanding the pressures, forces, and wear involved. This includes but is not limited to plastics, ferrous and non ferrous metals and alloys thereof, composite materials, ceramics, and various types of wood.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
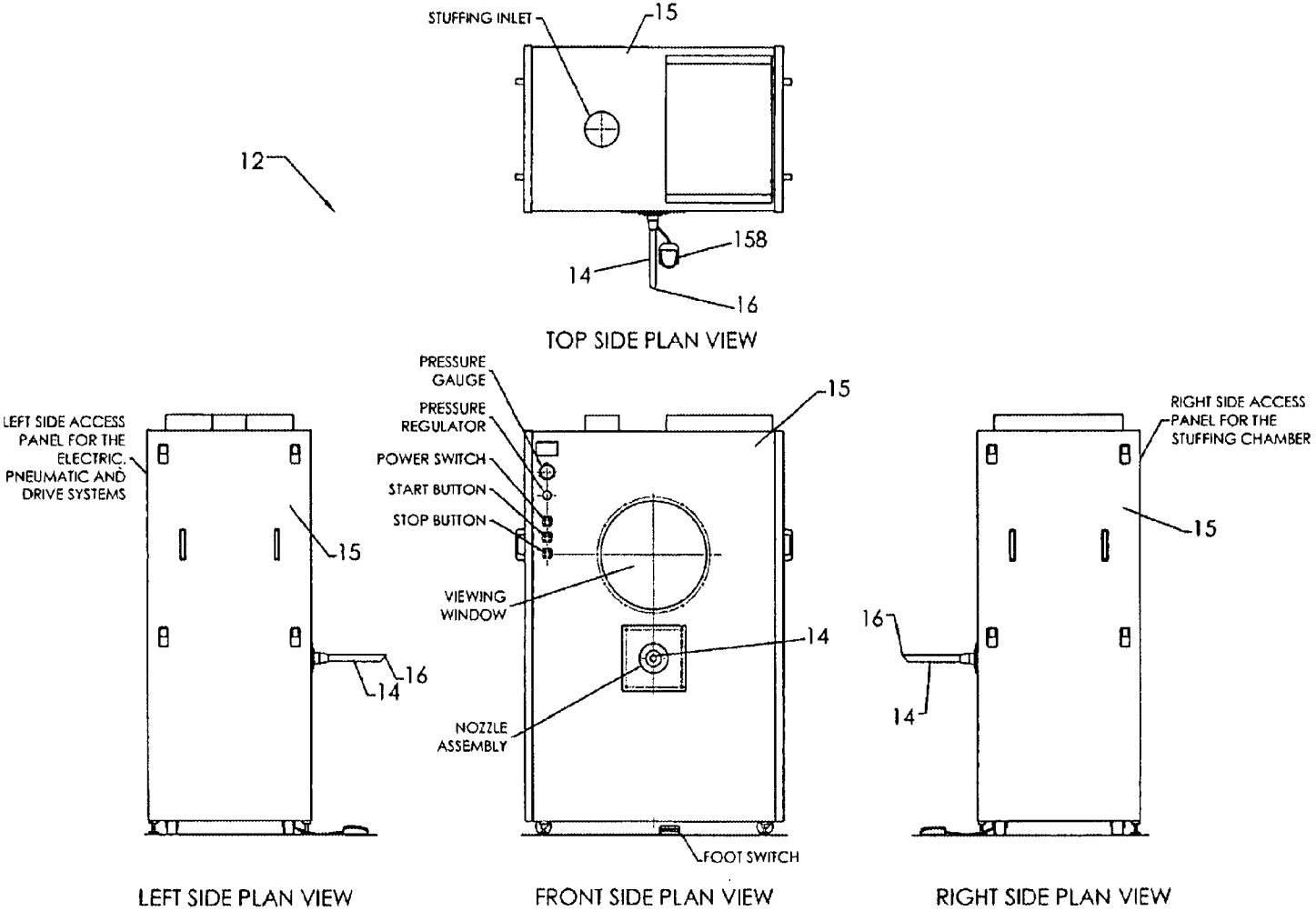
FIG. 1 shows external front, right, left, and top side plan views of an embodiment of the stuffing machine.
Figure 2:
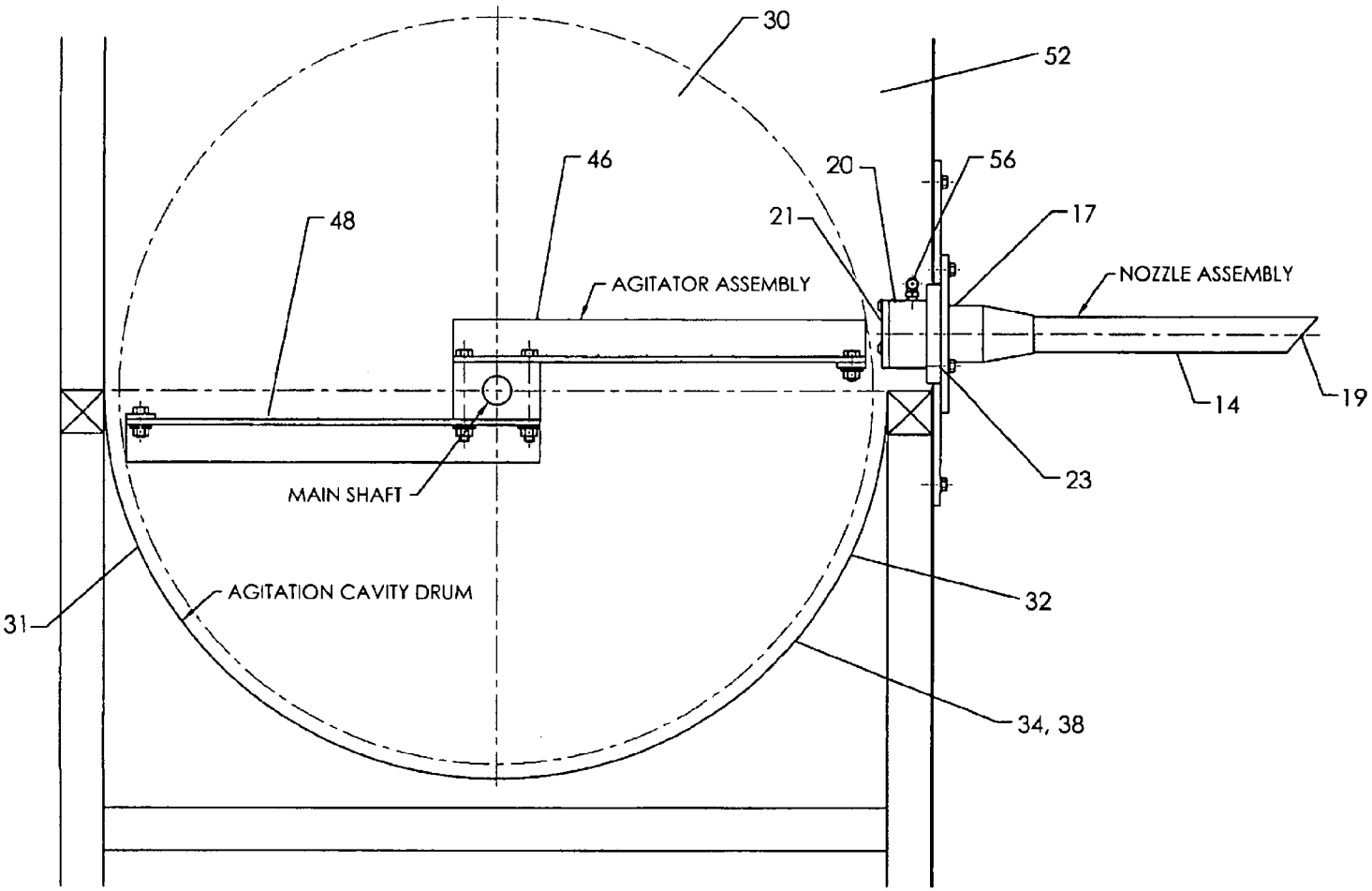
FIG. 2 shows an interior cross sectional left side view of the agitation cavity along with placement of the stuffing nozzle and venturi assembly of the stuffing machine.
Figure 3:
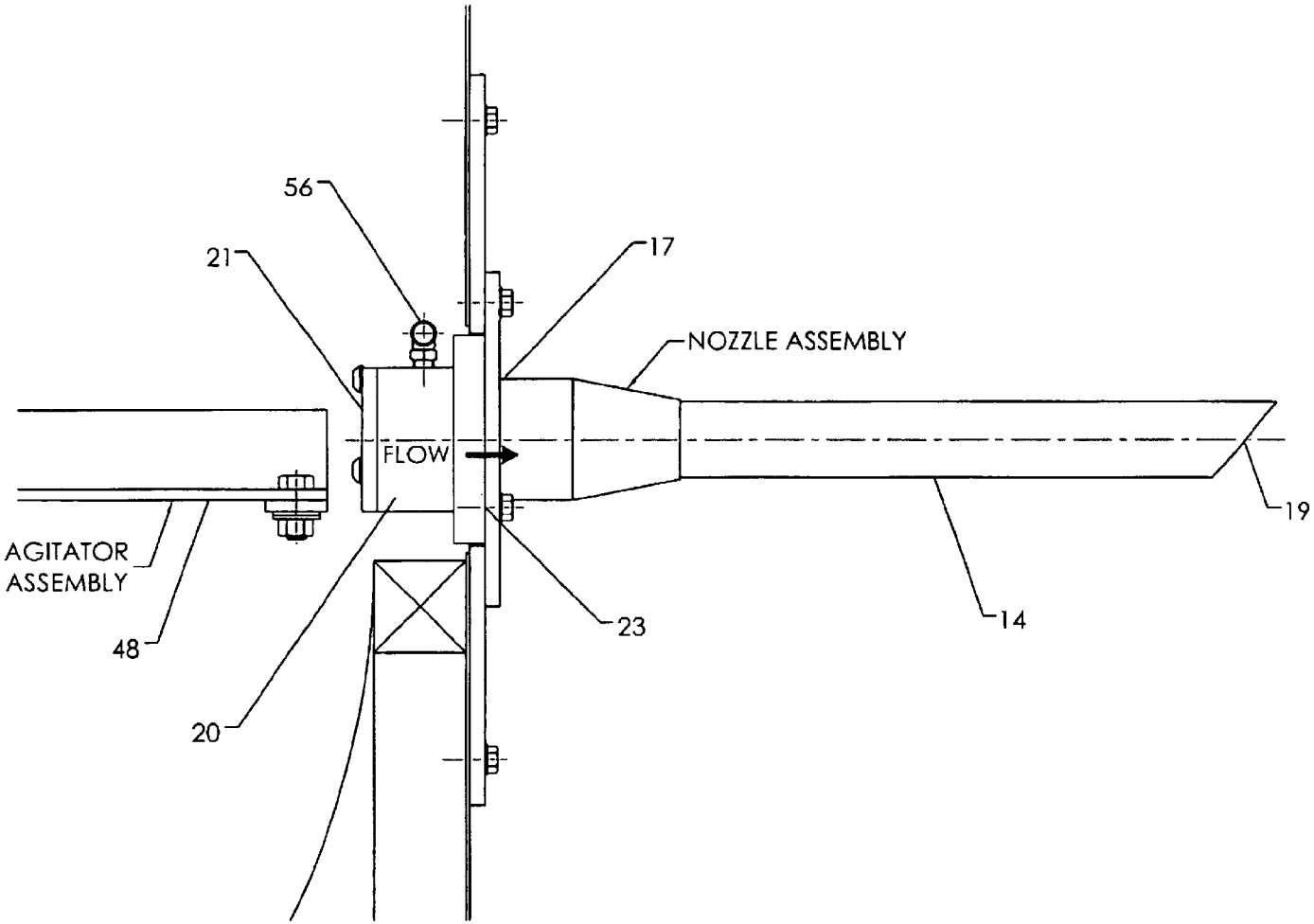
FIG. 3 shows an expanded view of the agitator blade and stuffing nozzle/venturi interface of the stuffing machine of FIG. 2.
Figure 4:
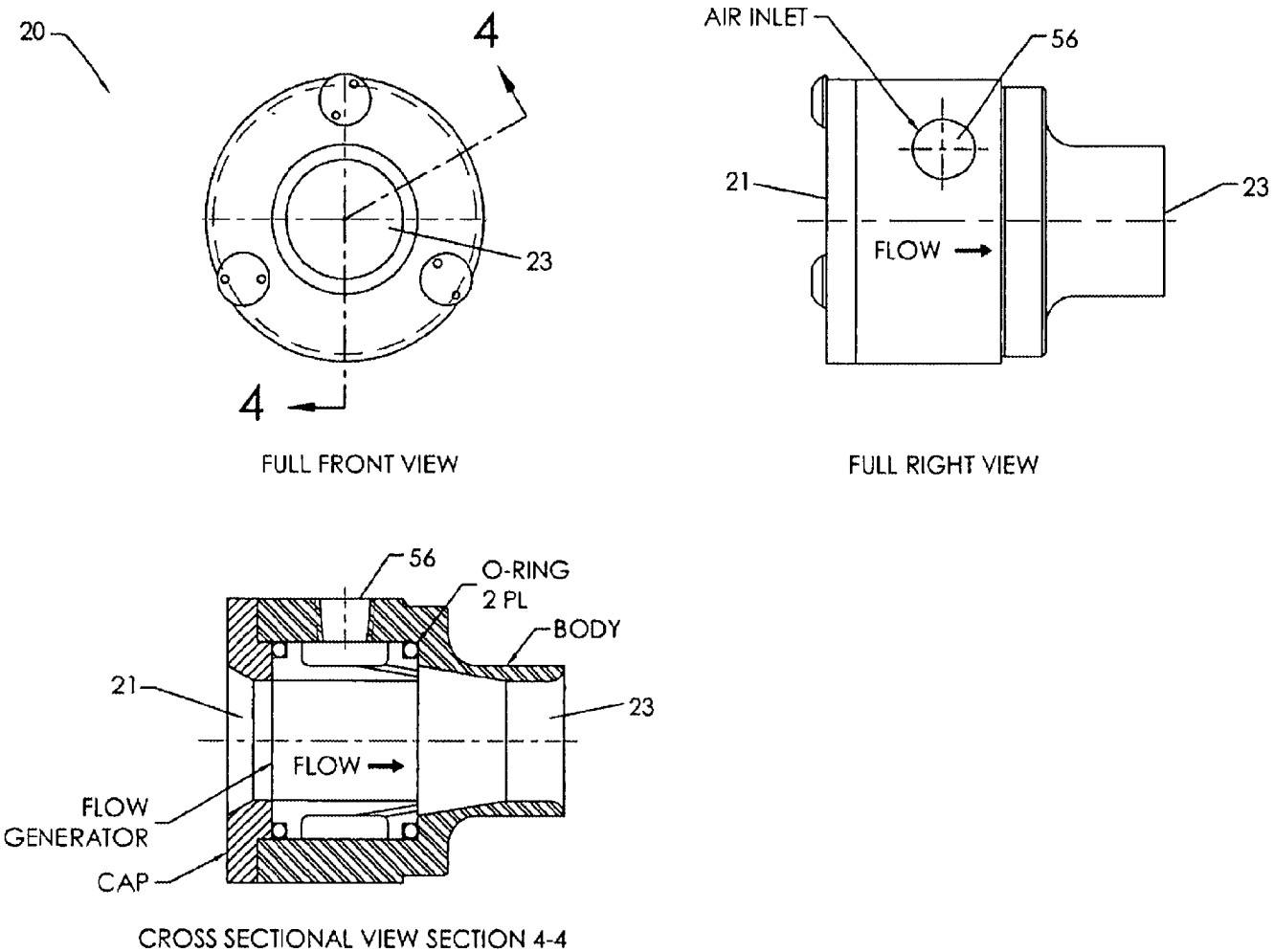
FIG. 4 shows the venturi in full front and right views and cross sectional view, Section 4—4, of the stuffing machine.
Figure 5:
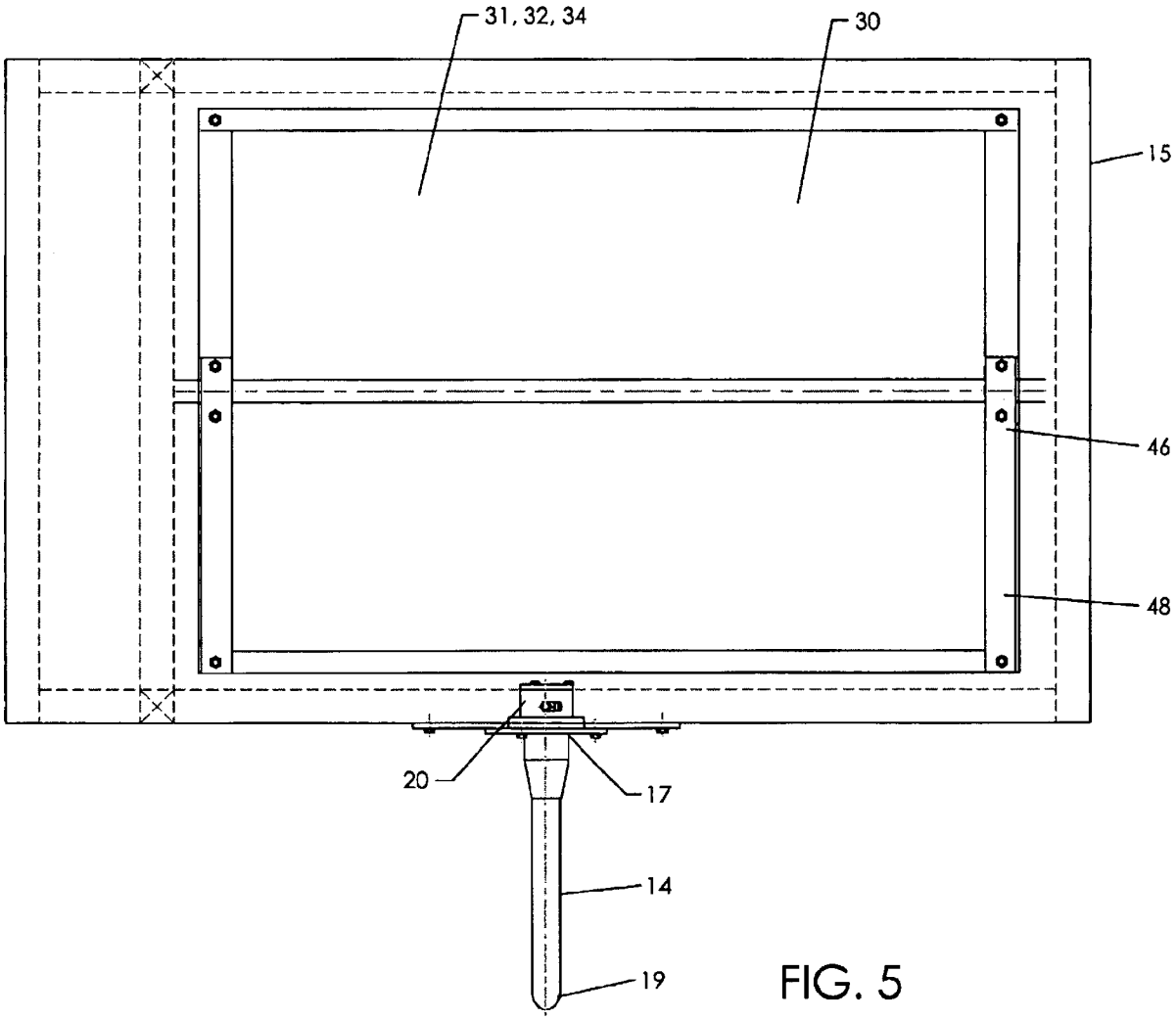
FIG. 5 shows a top plan view of the stuffing machine looking into the agitation cavity.
Figure 6:
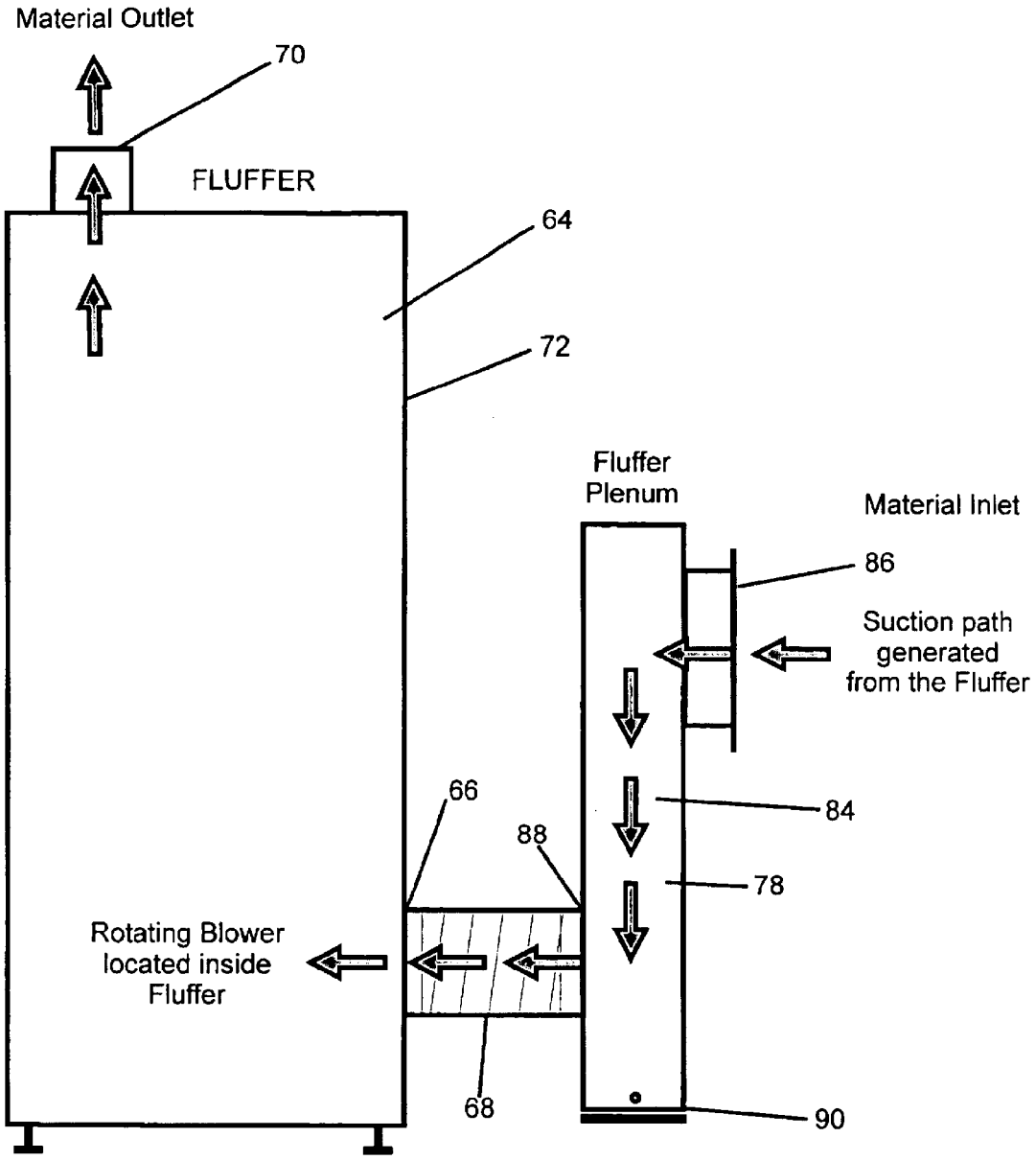
FIG. 6 shows a block diagram of the fluffer and plenum interface and theory of operation.
Figure 7:
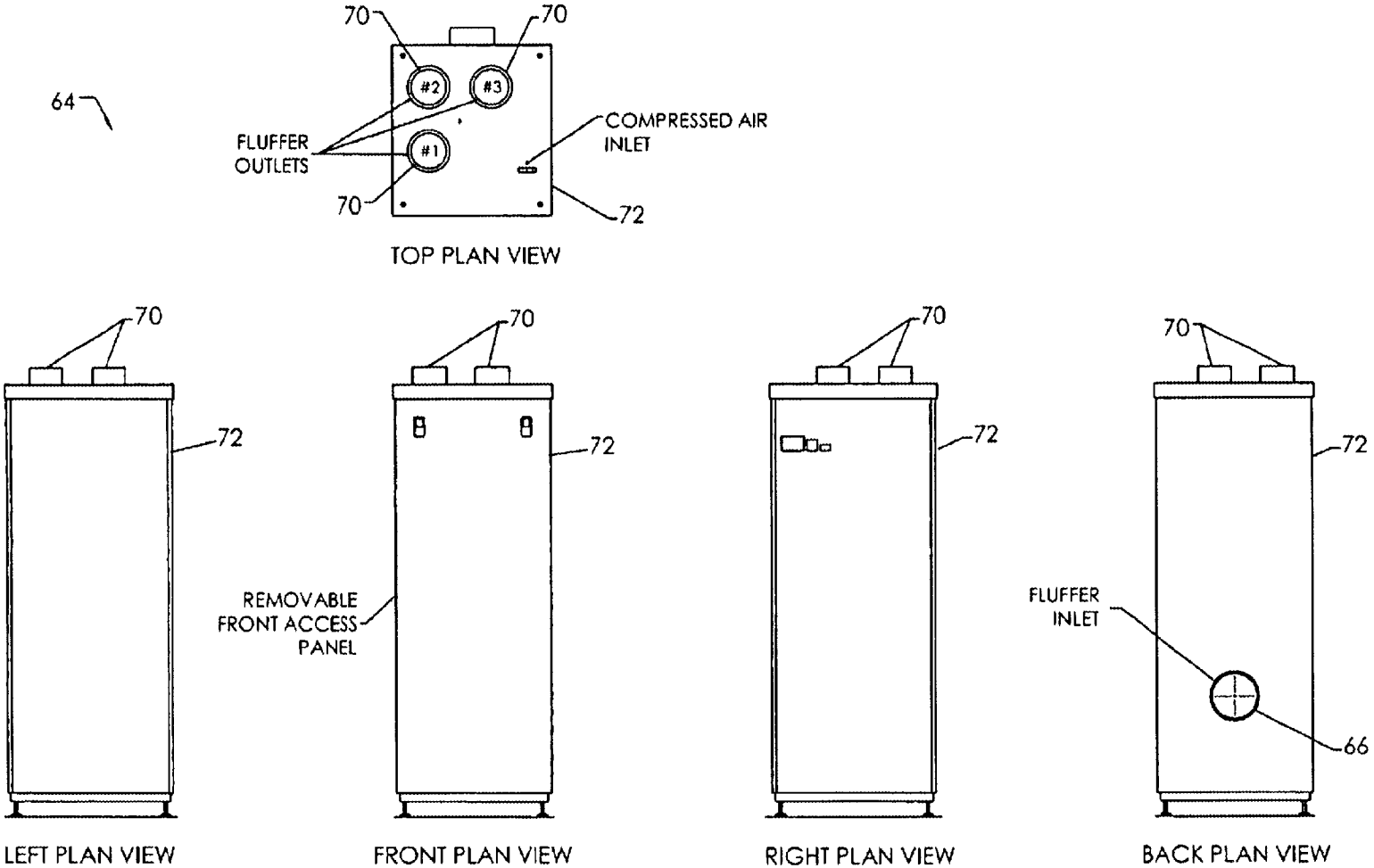
FIG. 7 shows full top, left, front, right, and back plan views for a stand alone fluffer along with the diverting blast gate valve fluffer outlets on the top side view.
Figure 8:
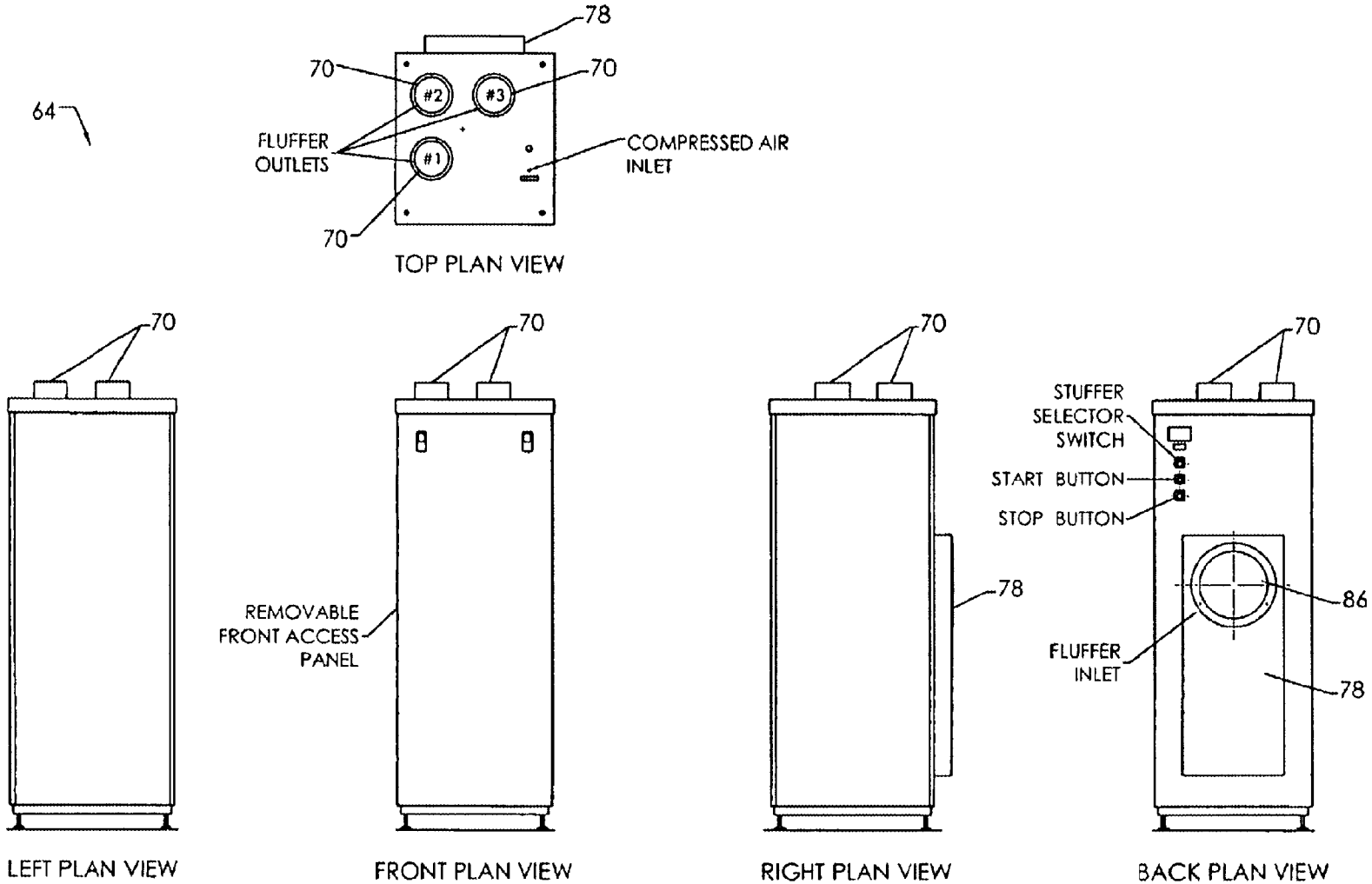
FIG. 8 shows the plan views of FIG. 7 with an attached plenum.
Figure 9:
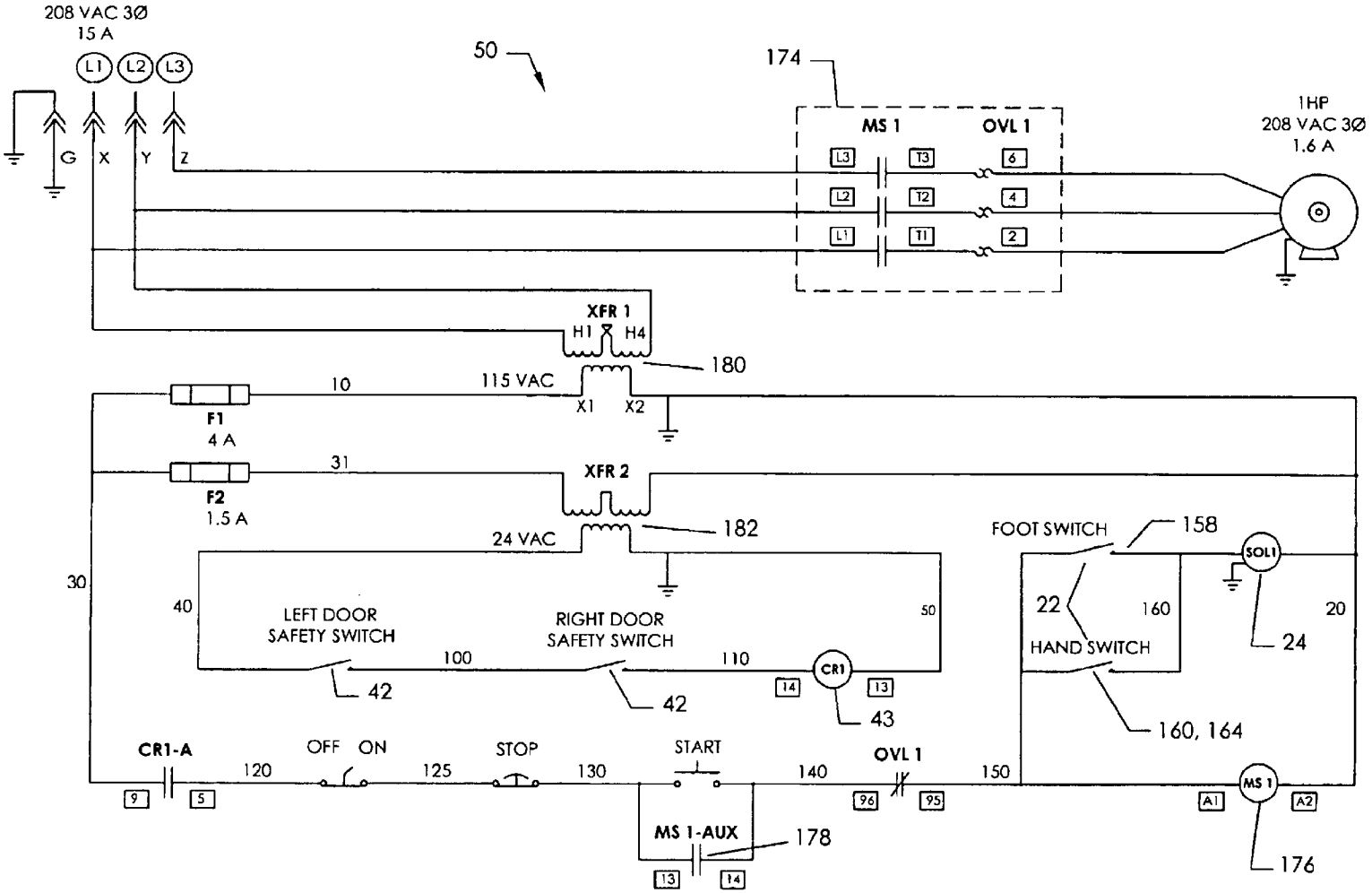
FIG. 9 shows an electric schematic for the stuffing machine showing the agitator motor control and door safety switch air pressurization interlock system.
Figure 10:
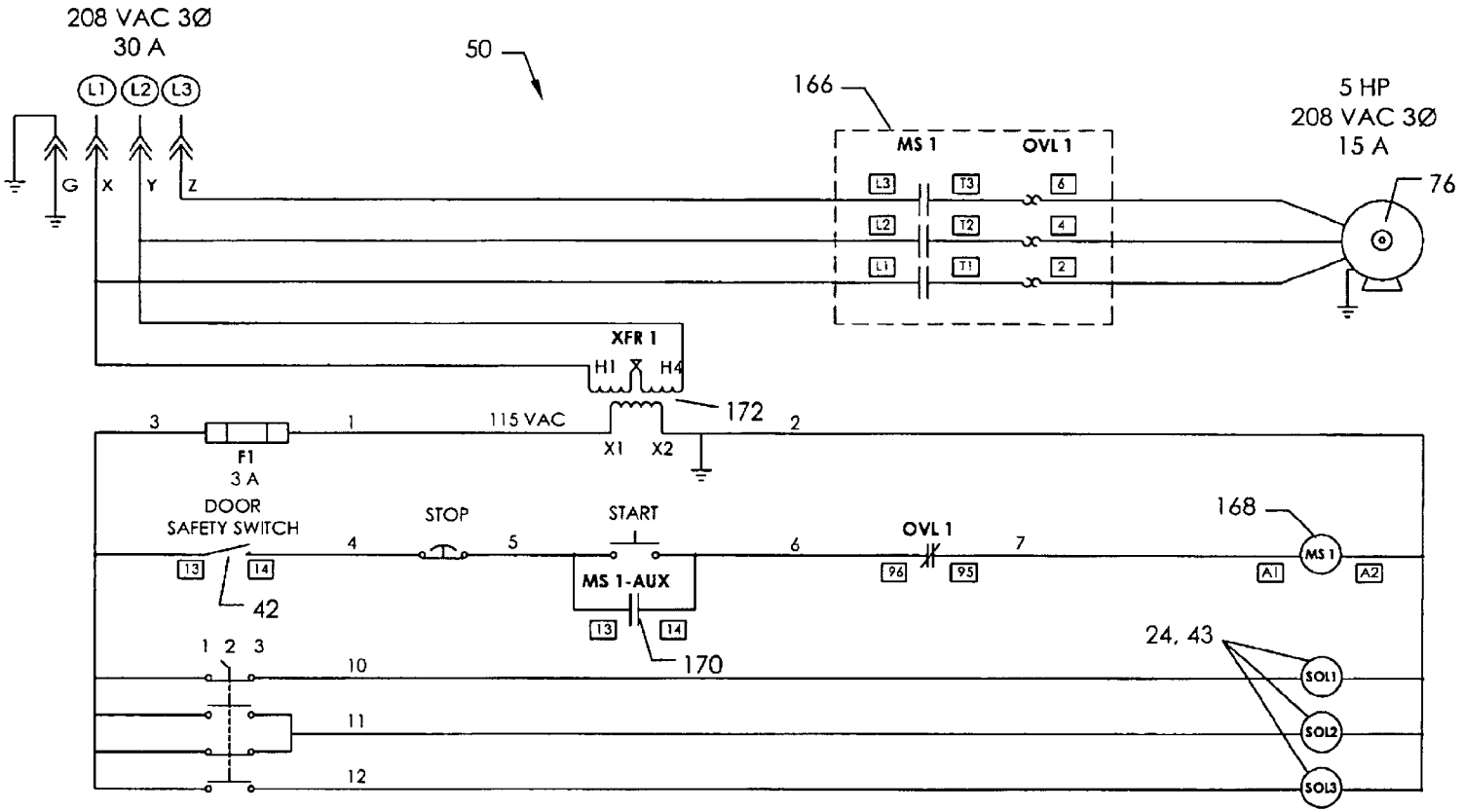
FIG. 10 shows an electric schematic for the fluffing machine showing the blower motor control, blast gate electropneumatic valves, and interlock system.
Figure 11:
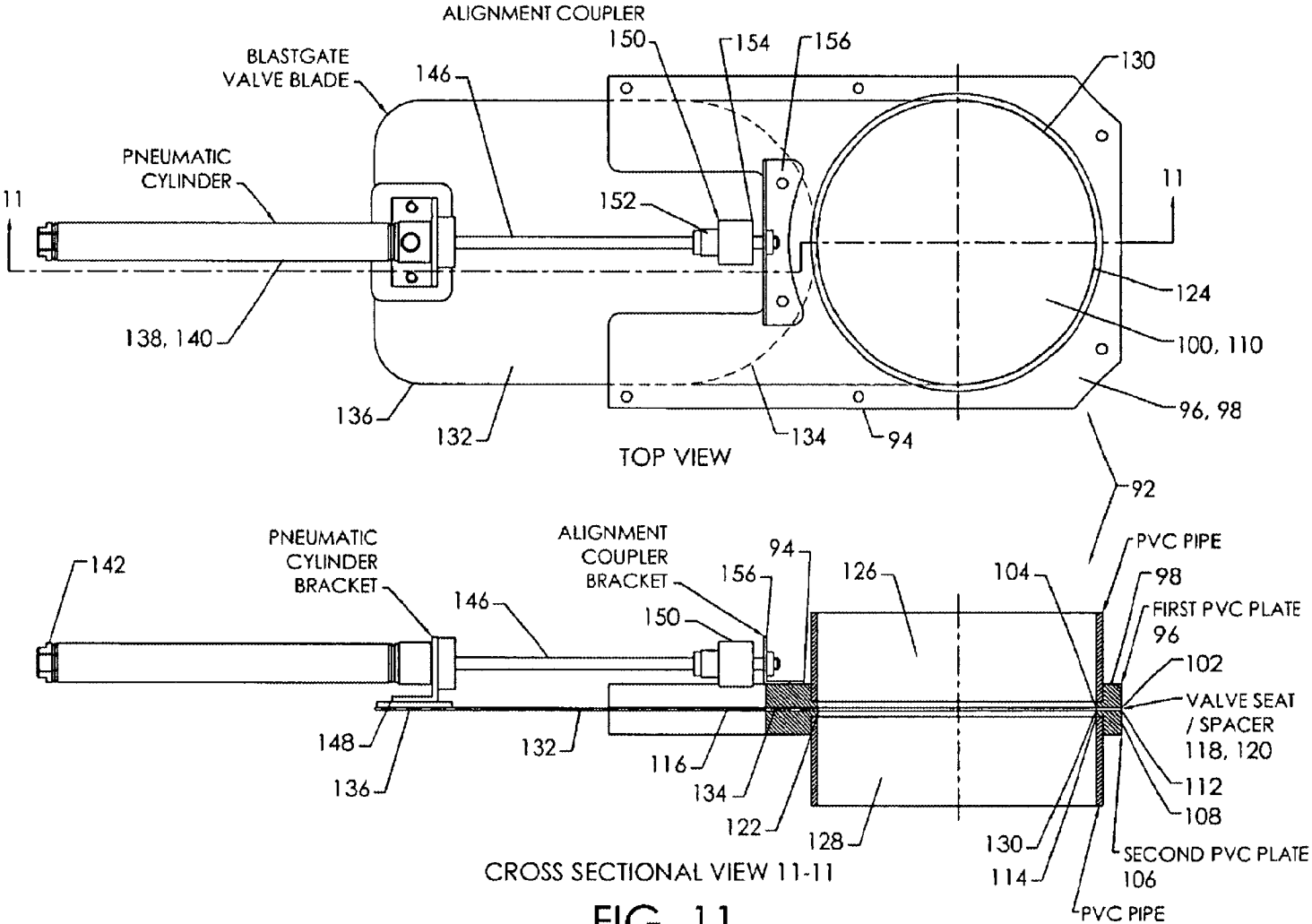
FIG. 11 shows a top view and cross sectional view 11—11 of the blast valve assembly in the open position with PVC pipe entrance and exiting portions.
Figure 12:
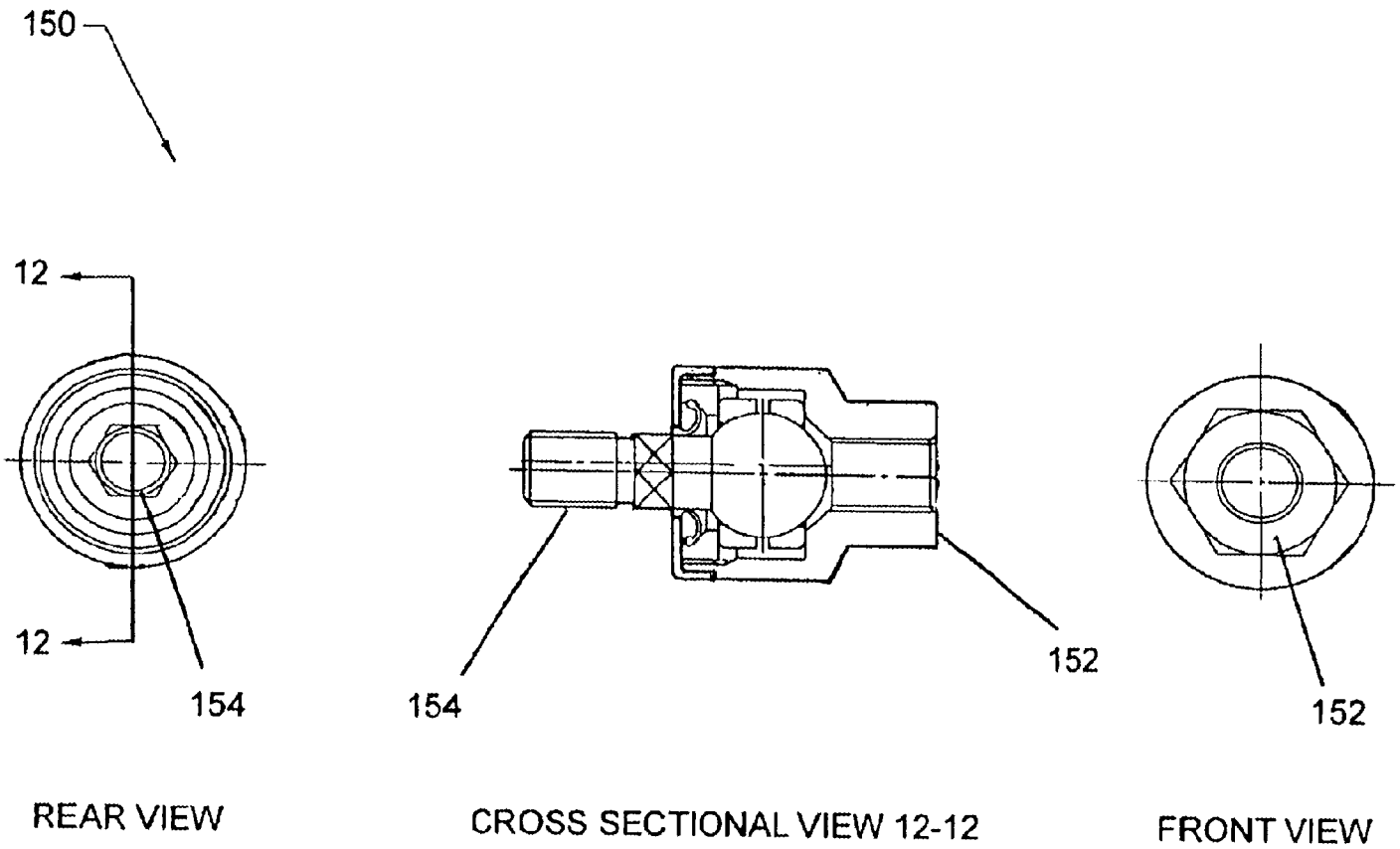
FIG. 12 shows a cross sectional view 12—12 and a front and rear view of the alignment coupler for said blast gate valve.
Figure 13:
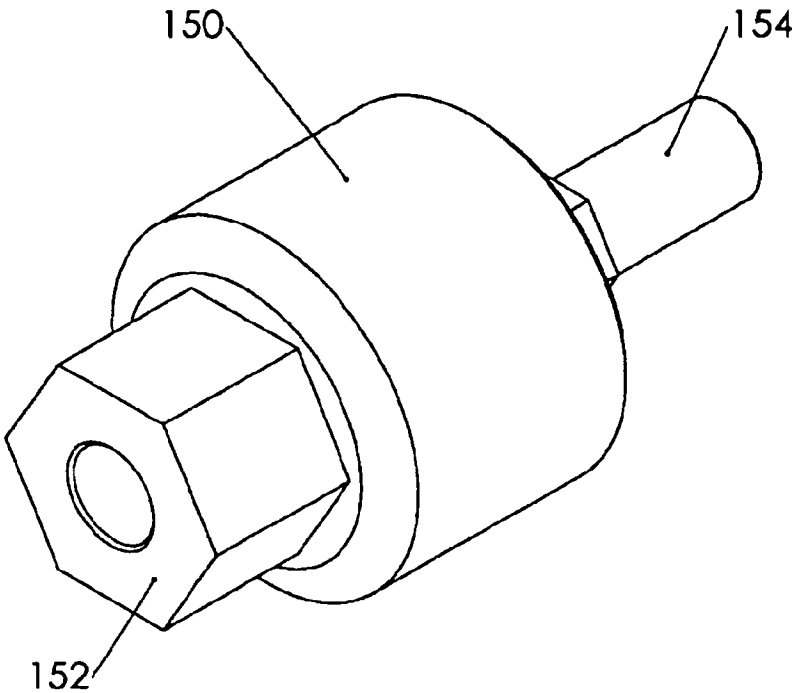
FIG. 13 shows a perspective view of the alignment coupler.
Figure 14:
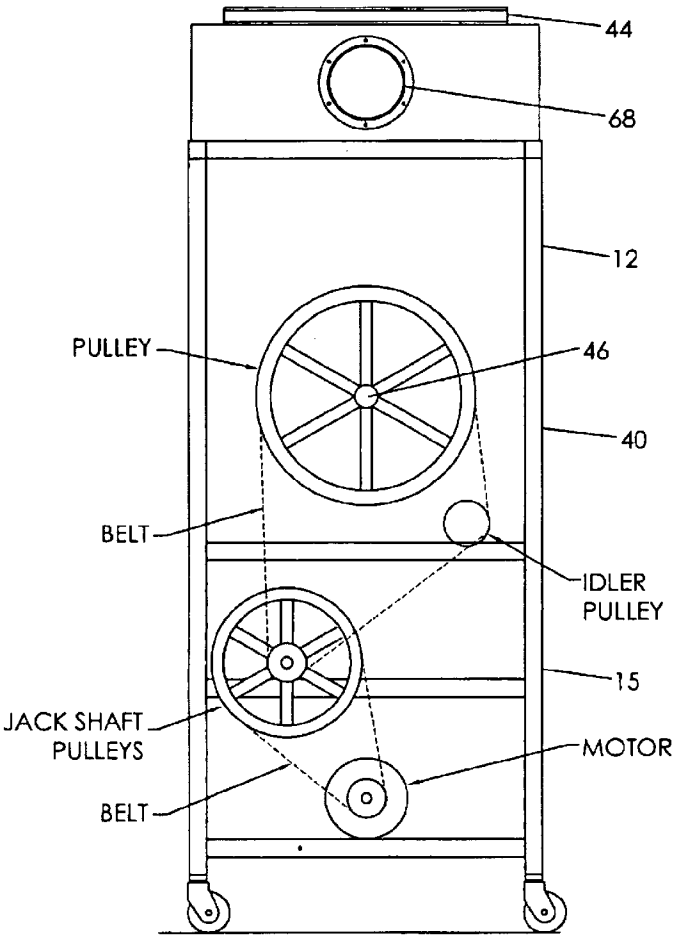
FIG. 14 shows a left side plan view of the internal motor, pulley, and belt arrangement for an embodiment of the stuffing machine.
Figure 15:
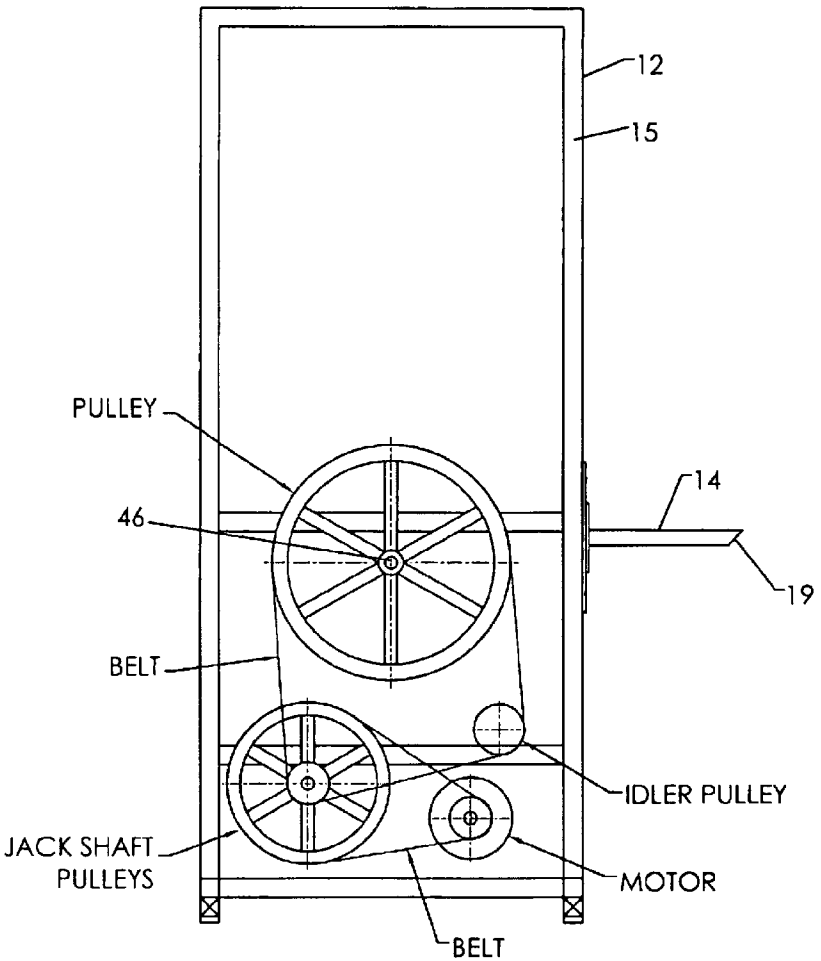
FIG. 15 shows a left side plan view of the internal motor, pulley, and belt arrangement for another embodiment of the stuffing machine.
Figure 16:
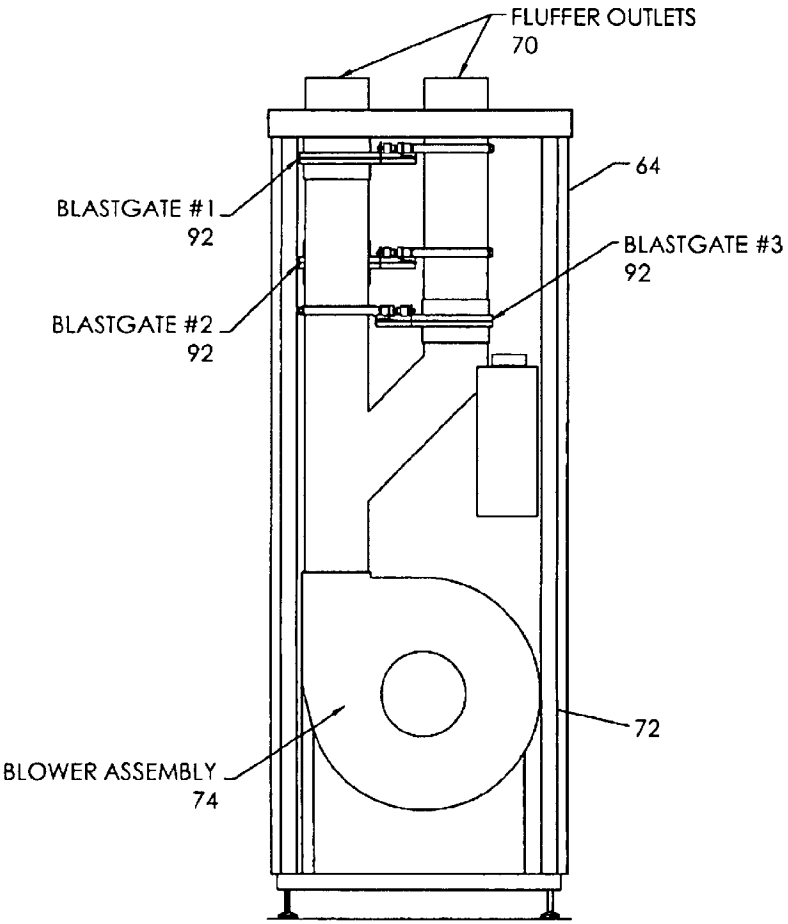
FIG. 16 shows a plan view of the internal blower, ductwork, and diverting blast gates for a fluffer having three exiting outlets.
Figure 17:
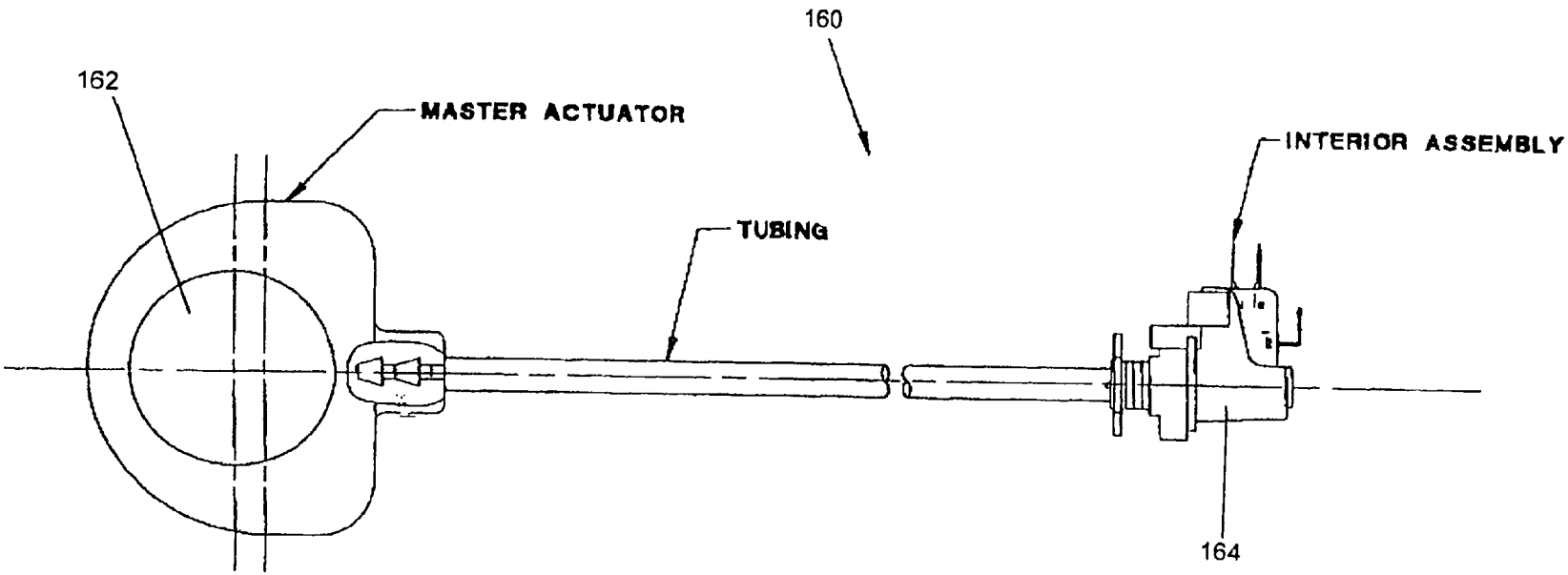
FIG. 17 shows a plan view of the hand actuated switch showing the extendable squeeze bulb, tubing, and electrical switch.
Figure 18:
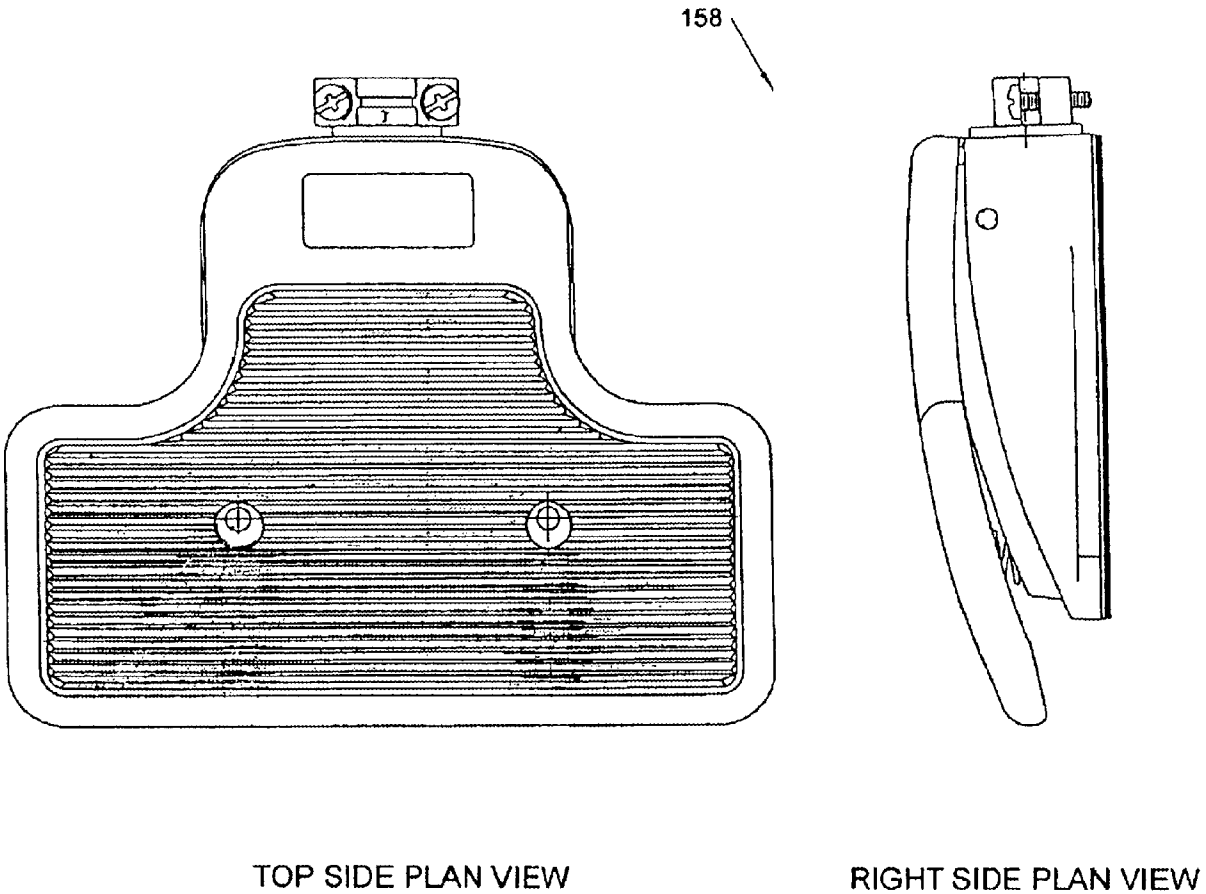
FIG. 18 shows a top and right side plan view of the electric foot switch.
Figure 19:
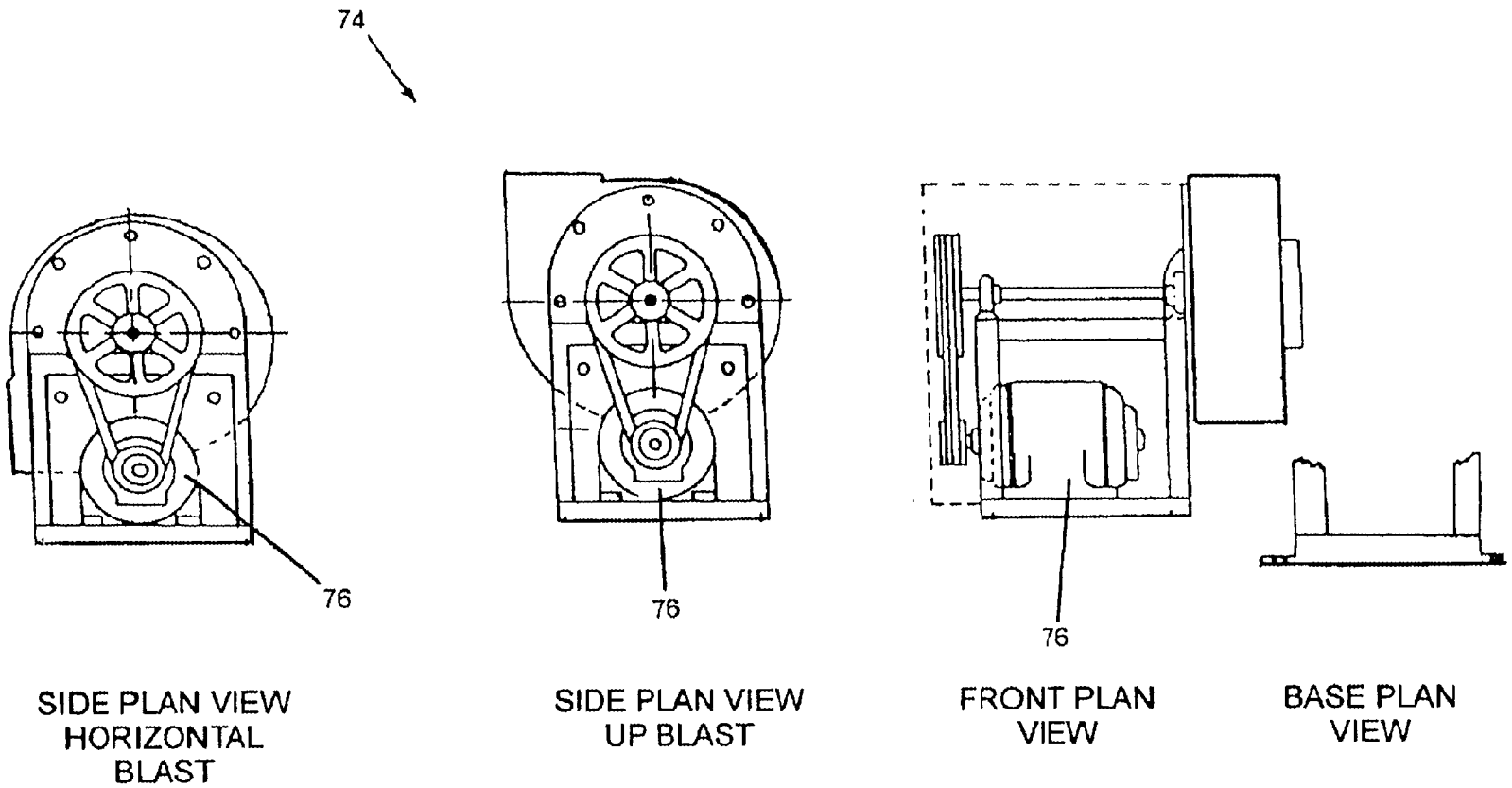
FIG. 19 shows side horizontal blast, side up blast, front, and base plan views for the blower, blower motor, and impeller housing used in the preferred embodiment of the fluffer.
Figure 20:
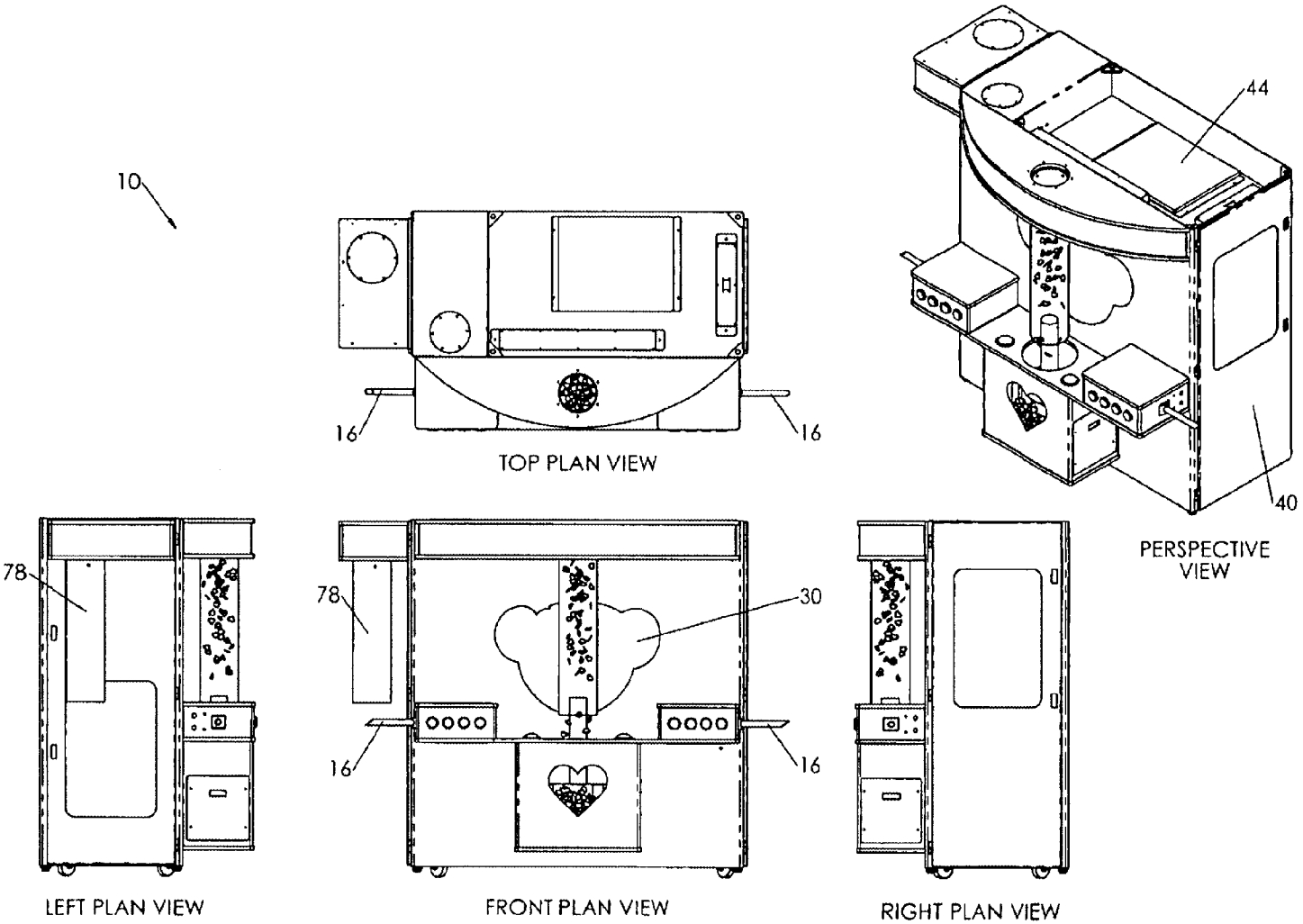
FIG. 20 shows a front, left, right, top, plan view and perspective view of the integrated stuffer/fluffer showing the feed separation plenum, swiveling nozzles, and general footprint thereof.
Figure 21:
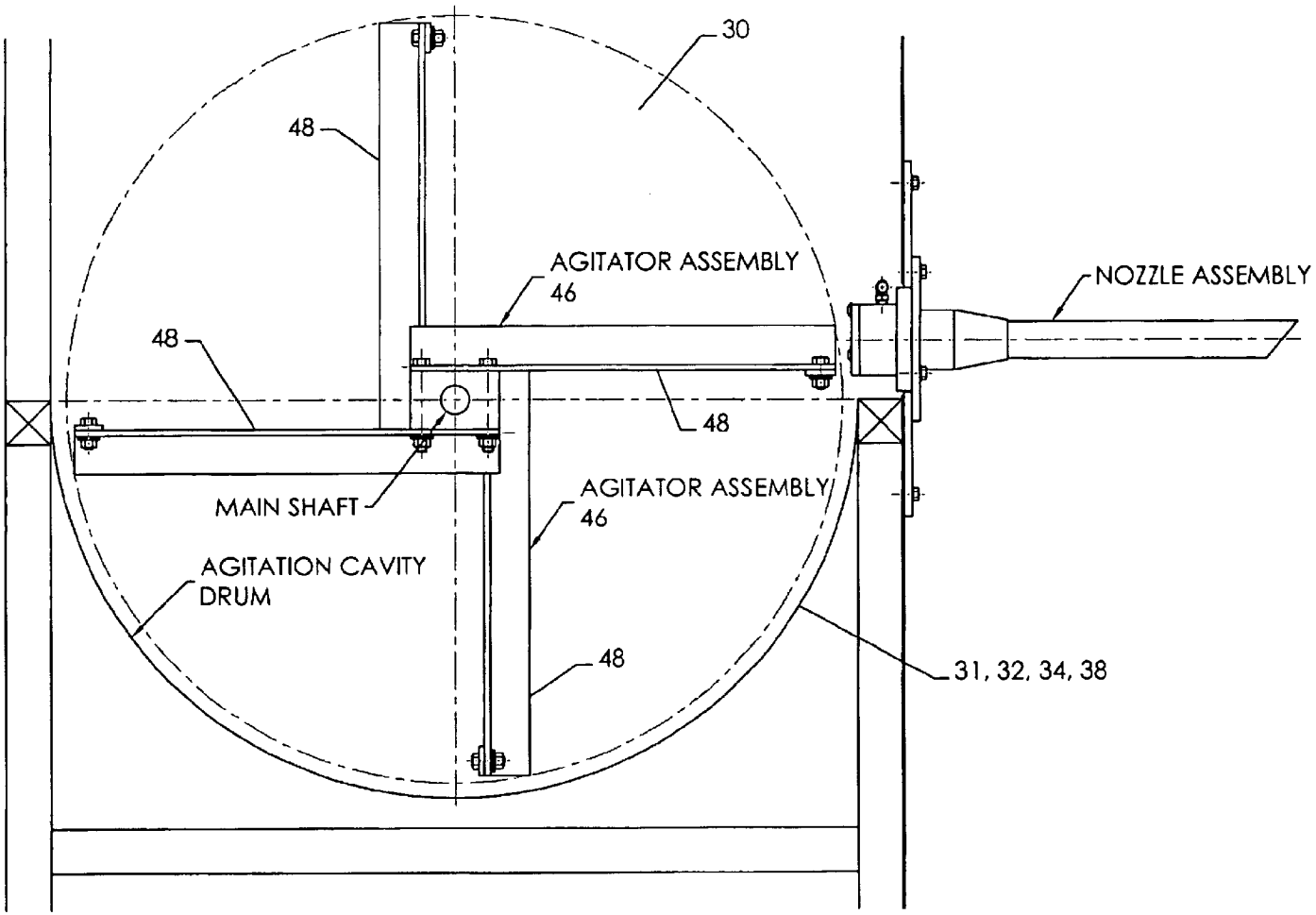
FIG. 21 shows an equivalent cross sectional view of FIG. 2 except with agitator blades offset relative to each other.
Figure 22:
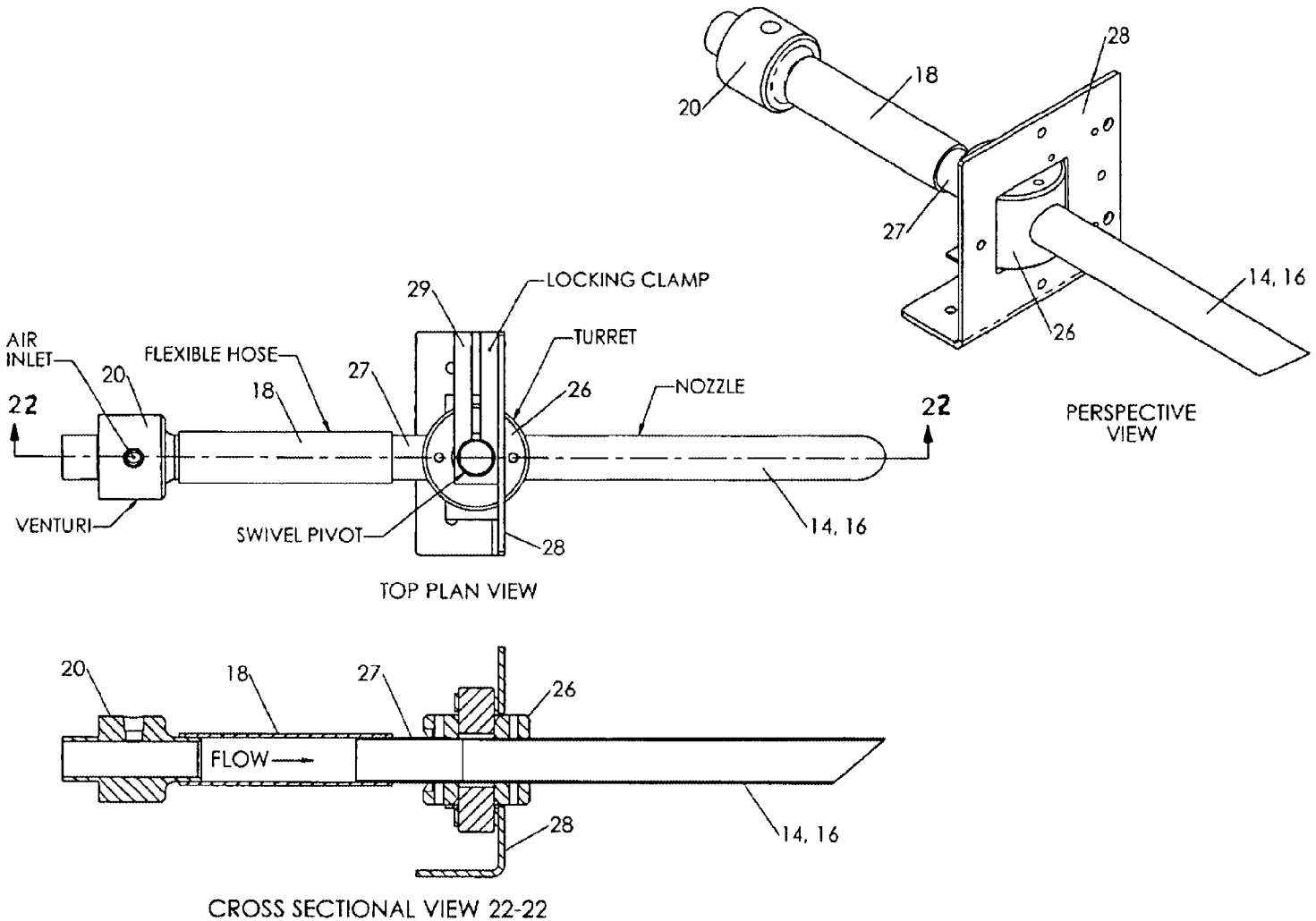
FIG. 22 shows a perspective view, top plan view, and cross sectional view along line 22—22 of the swivel nozzle and extension hose.
Figure 23:
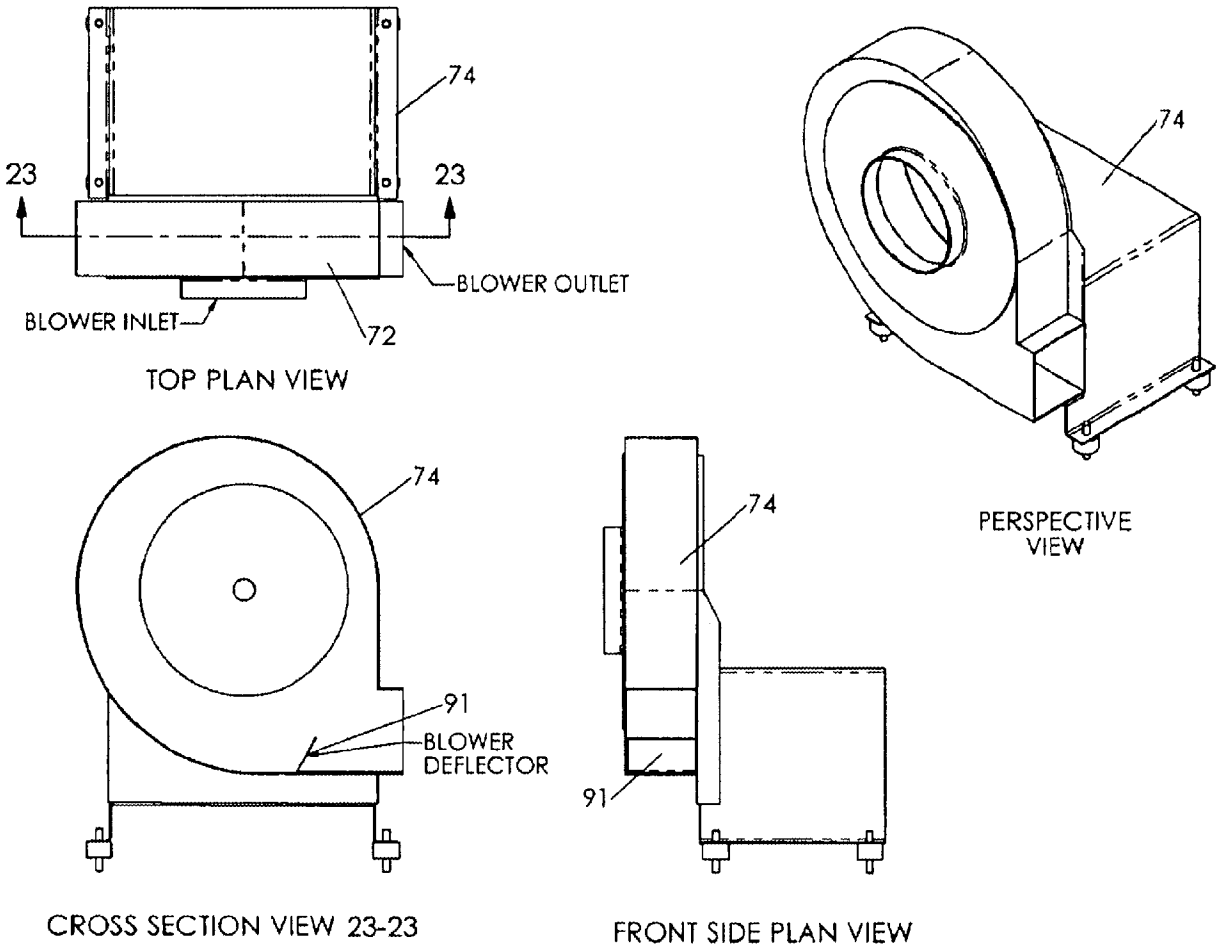
FIG. 23 shows a perspective view, top and front side plan view, and cross section view 23—23 of an embodiment of the blower, showing the deflector plate in said cross sectional view.
Figure 24:
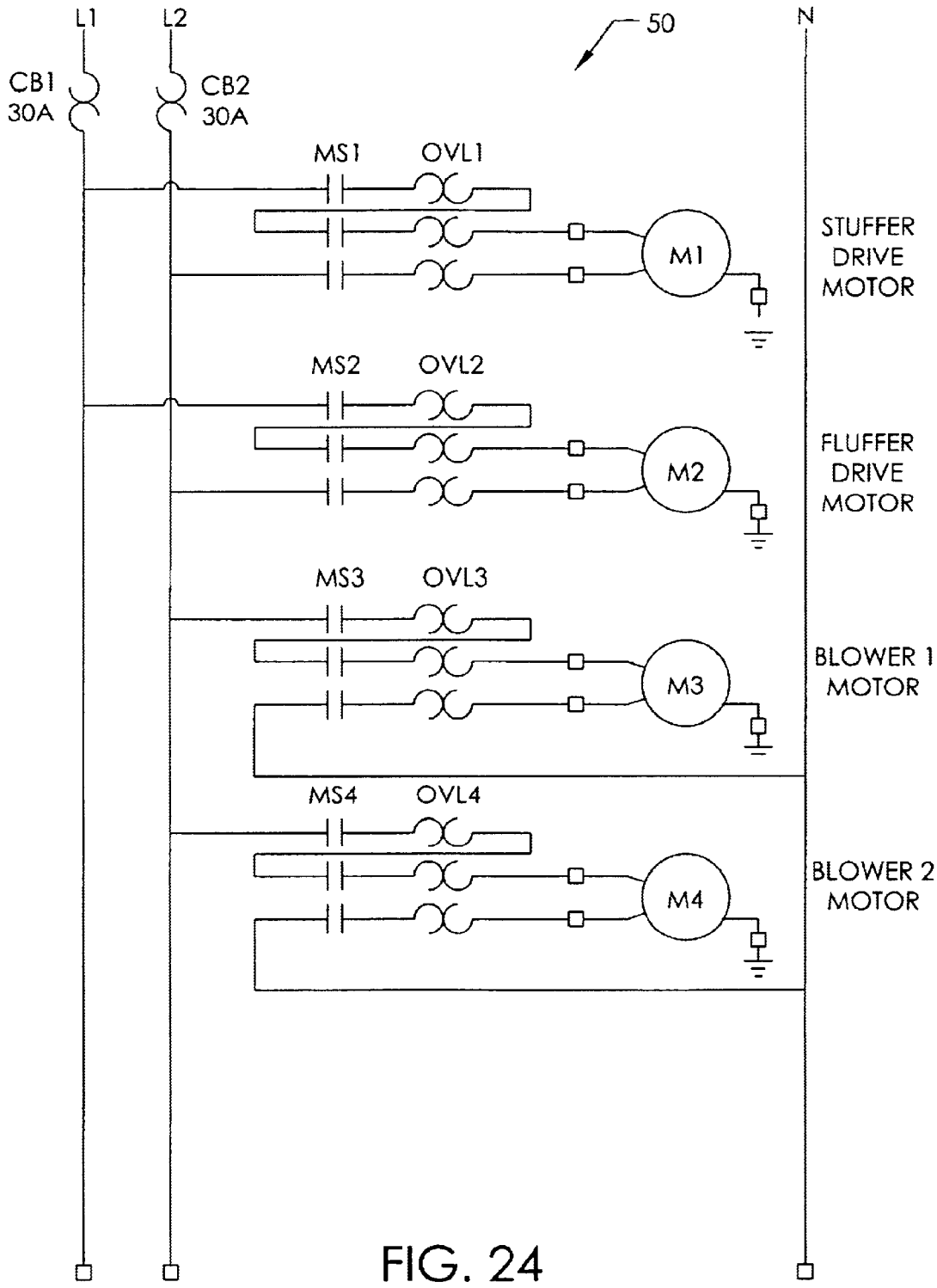
FIG. 24 shows a first portion of the electrical schematic for the integrated stuffing and fluffing machine which utilizes a programable logic controller.
Figure 25:
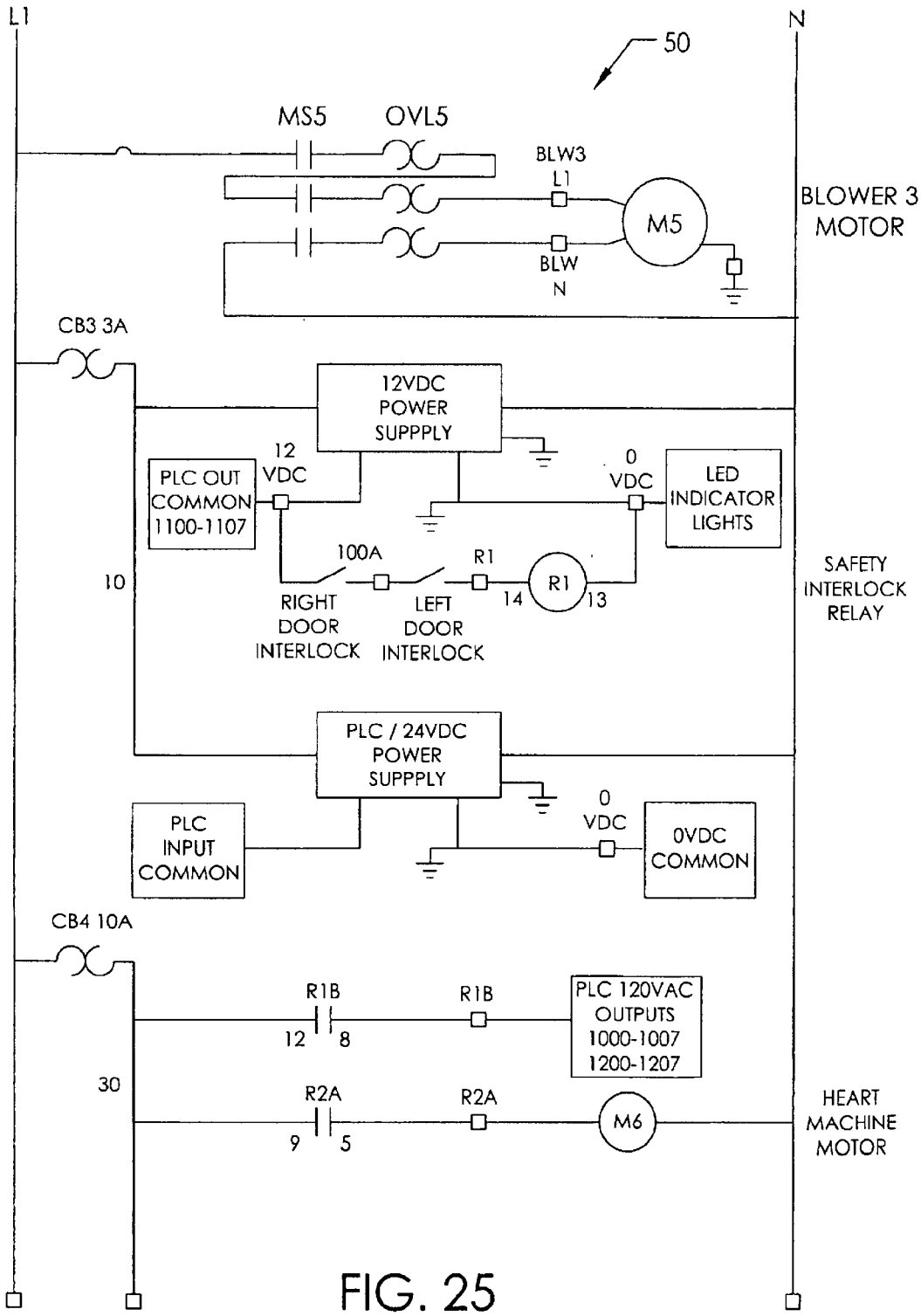
FIG. 25 shows a second portion of the electrical schematic for the integrated stuffing and fluffing machine which utilizes a programable logic controller.
Figure 26:
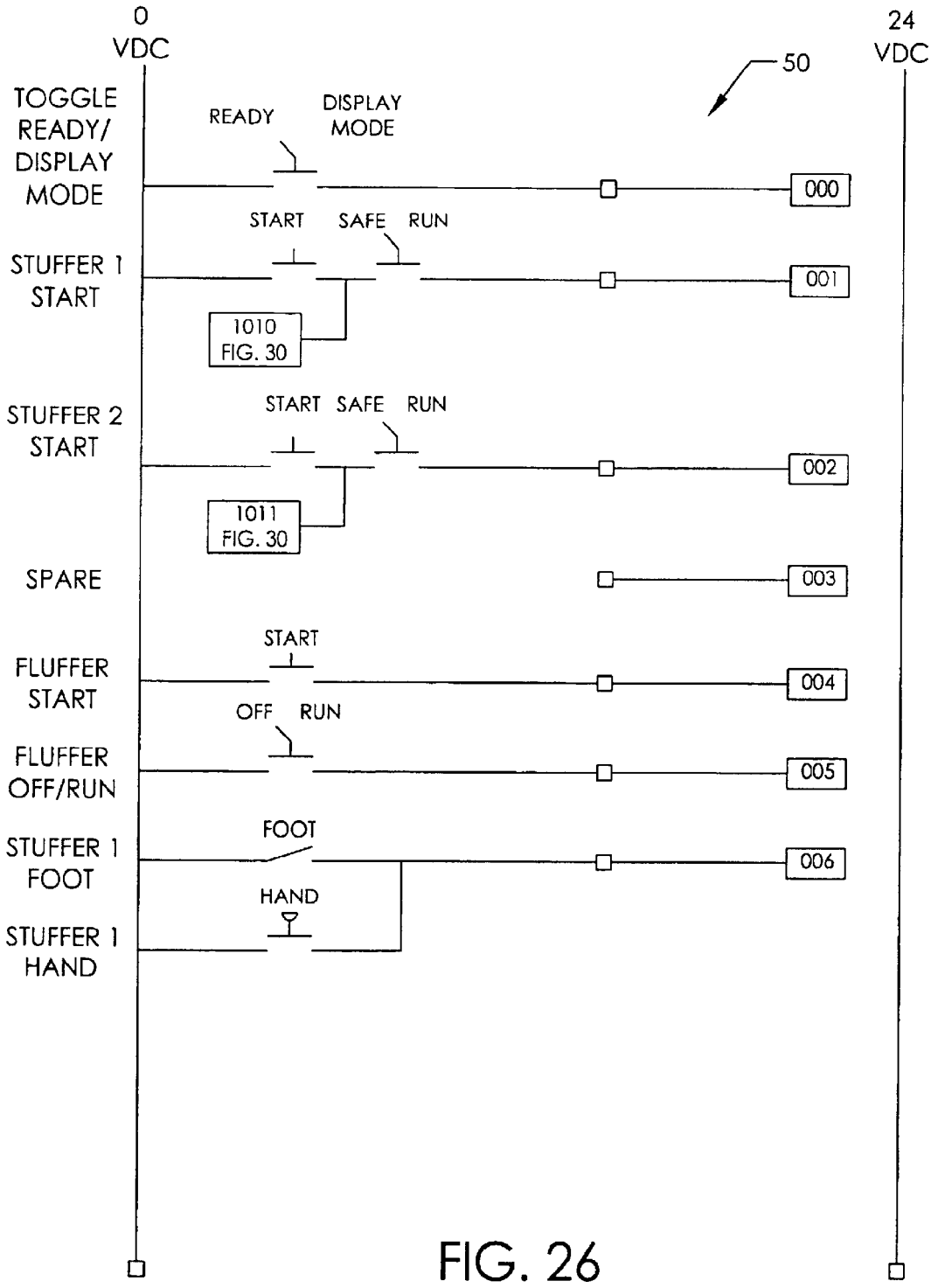
FIG. 26 shows a third portion of the electrical schematic for the integrated stuffing and fluffing machine which utilizes a programable logic controller.
Figure 27:
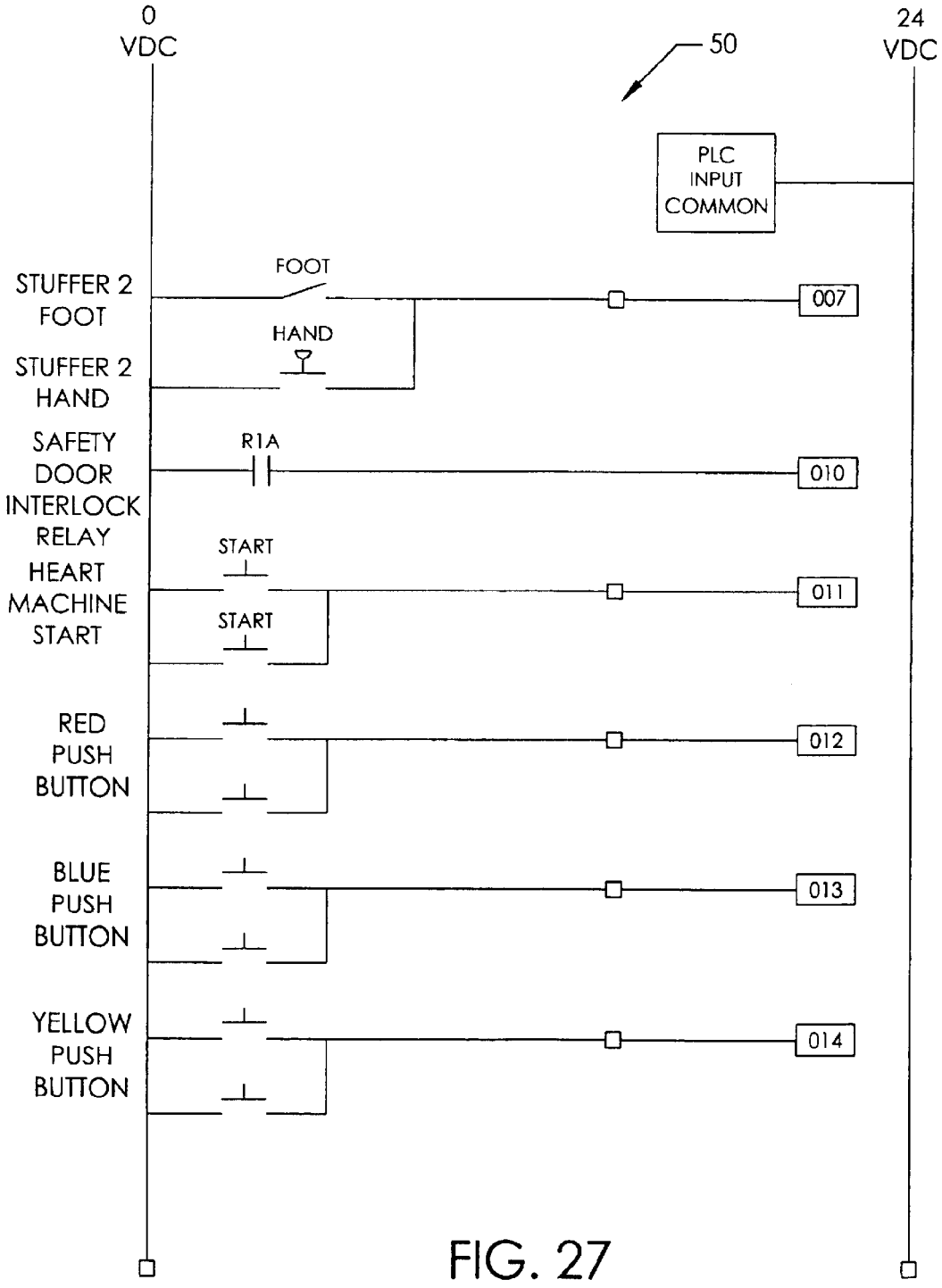
FIG. 27 shows a fourth portion of the electrical schematic for the integrated stuffing and fluffing machine which utilizes a programable logic controller.
Figure 28:
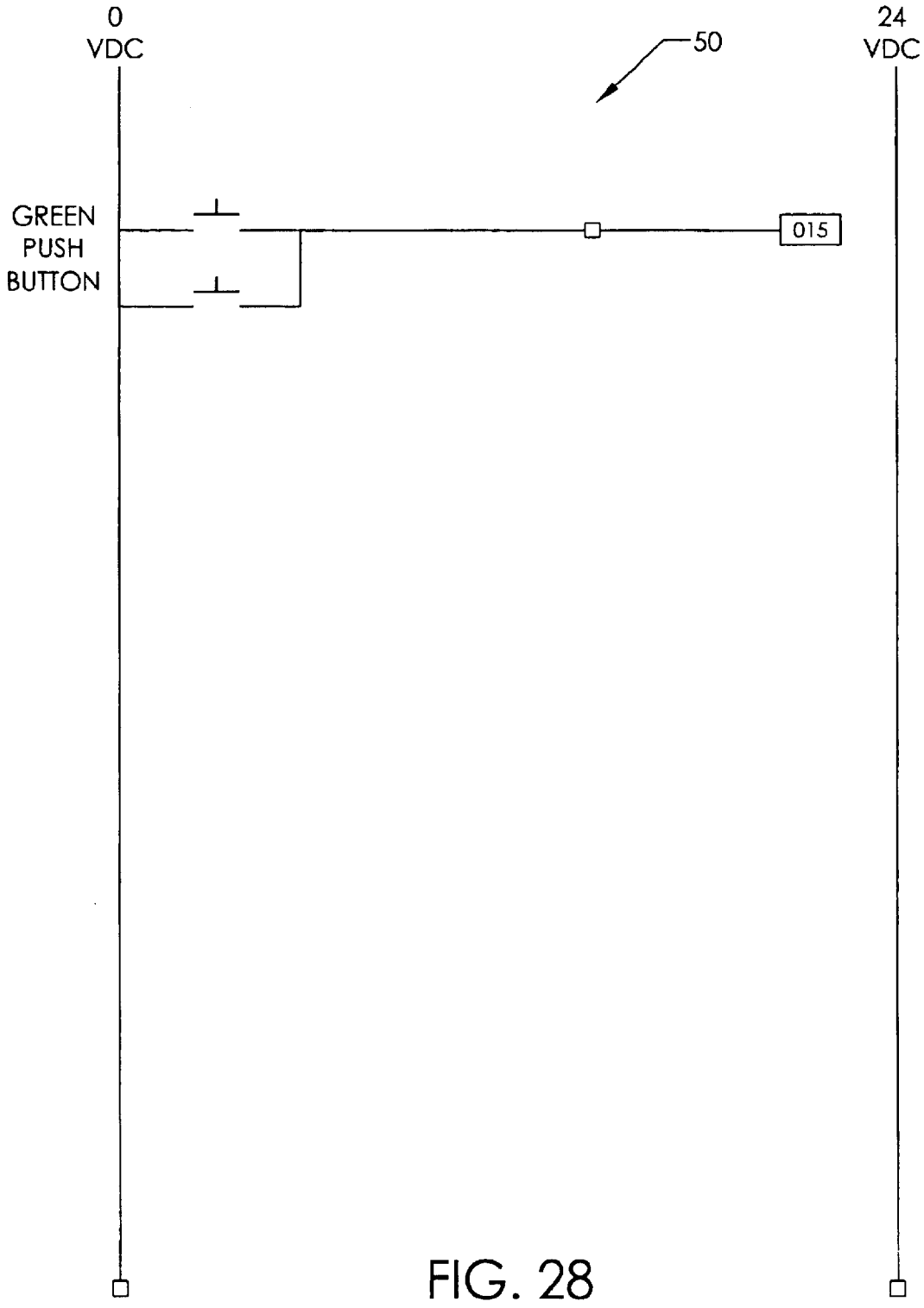
FIG. 28 shows a fifth portion of the electrical schematic for the integrated stuffing and fluffing machine which utilizes a programable logic controller.
Figure 29:
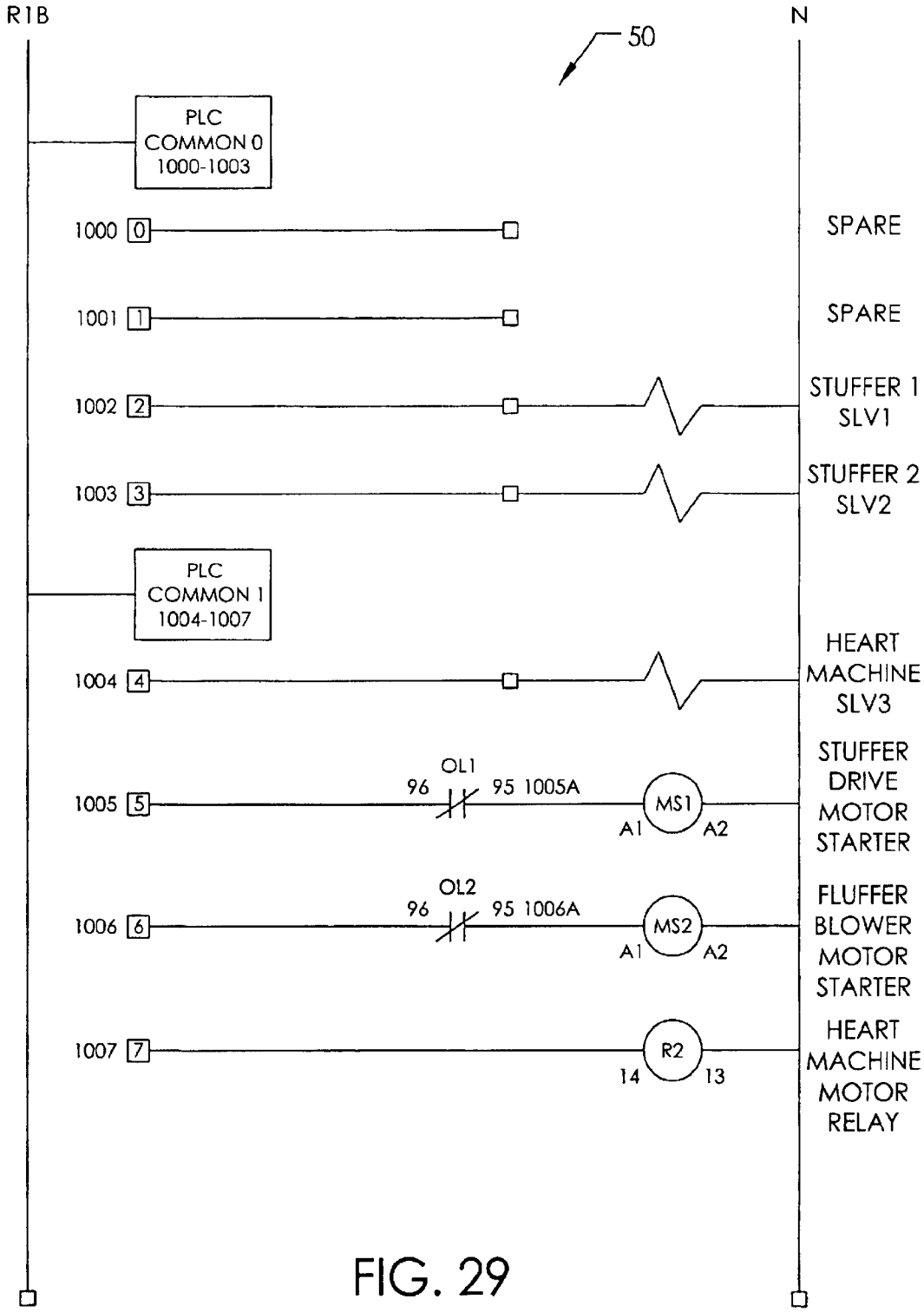
FIG. 29 shows a sixth portion of the electrical schematic for the integrated stuffing and fluffing machine which utilizes a programable logic controller.
Figure 30:
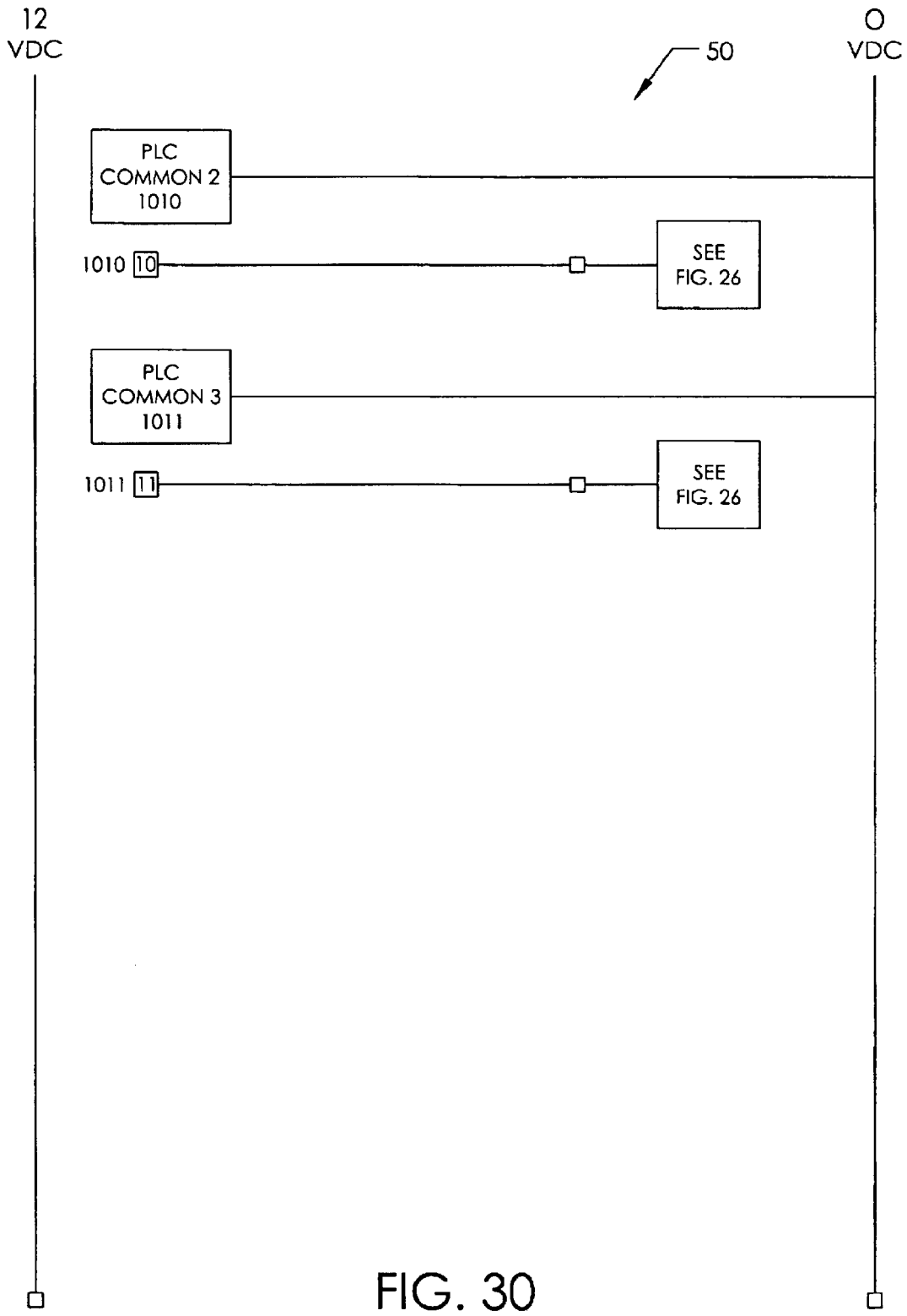
FIG. 30 shows a seventh portion of the electrical schematic for the integrated stuffing and fluffing machine which utilizes a programable logic controller.
Figure 31:
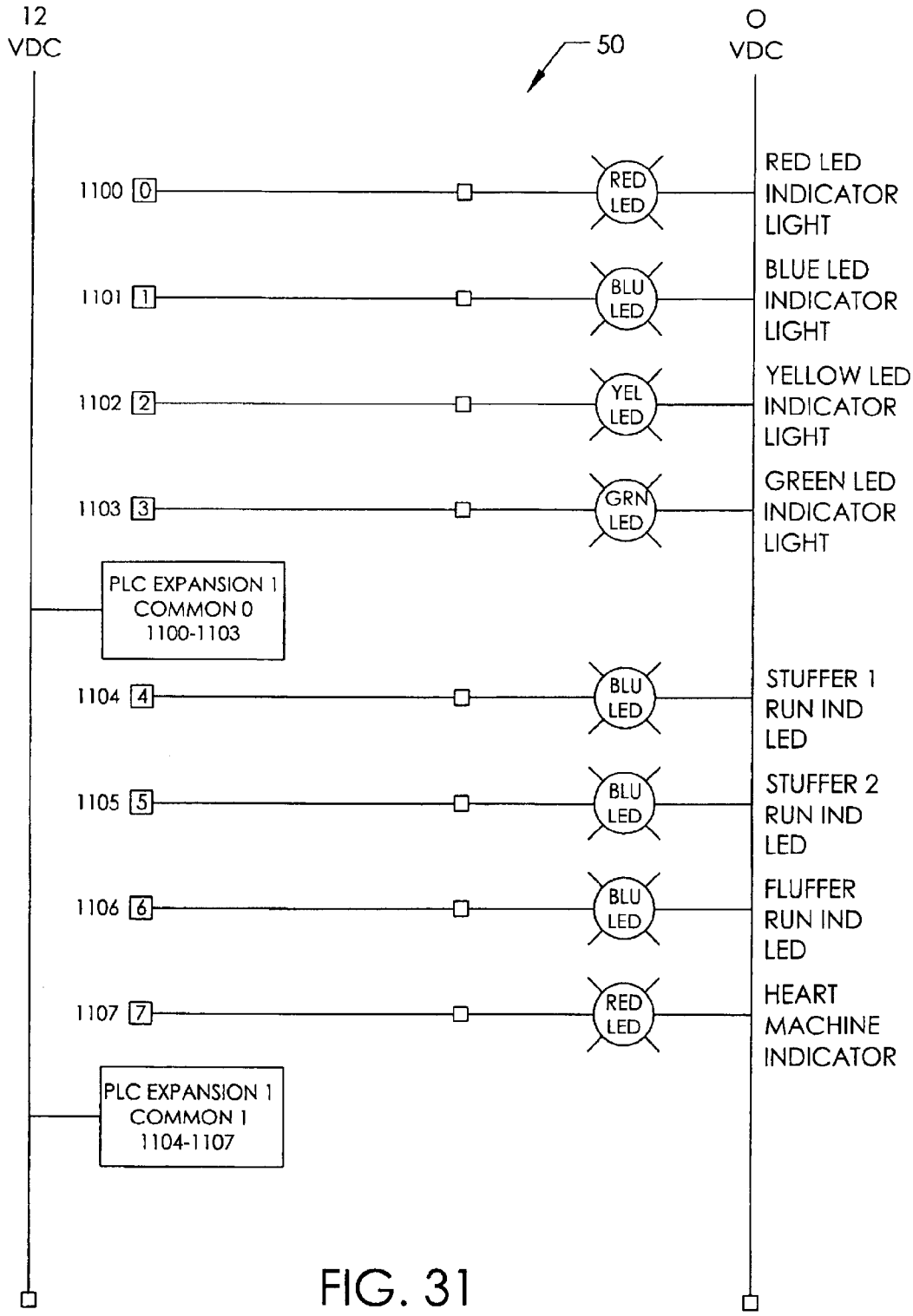
FIG. 31 shows a eighth portion of the electrical schematic for the integrated stuffing and fluffing machine which utilizes a programable logic controller.
Figure 32:
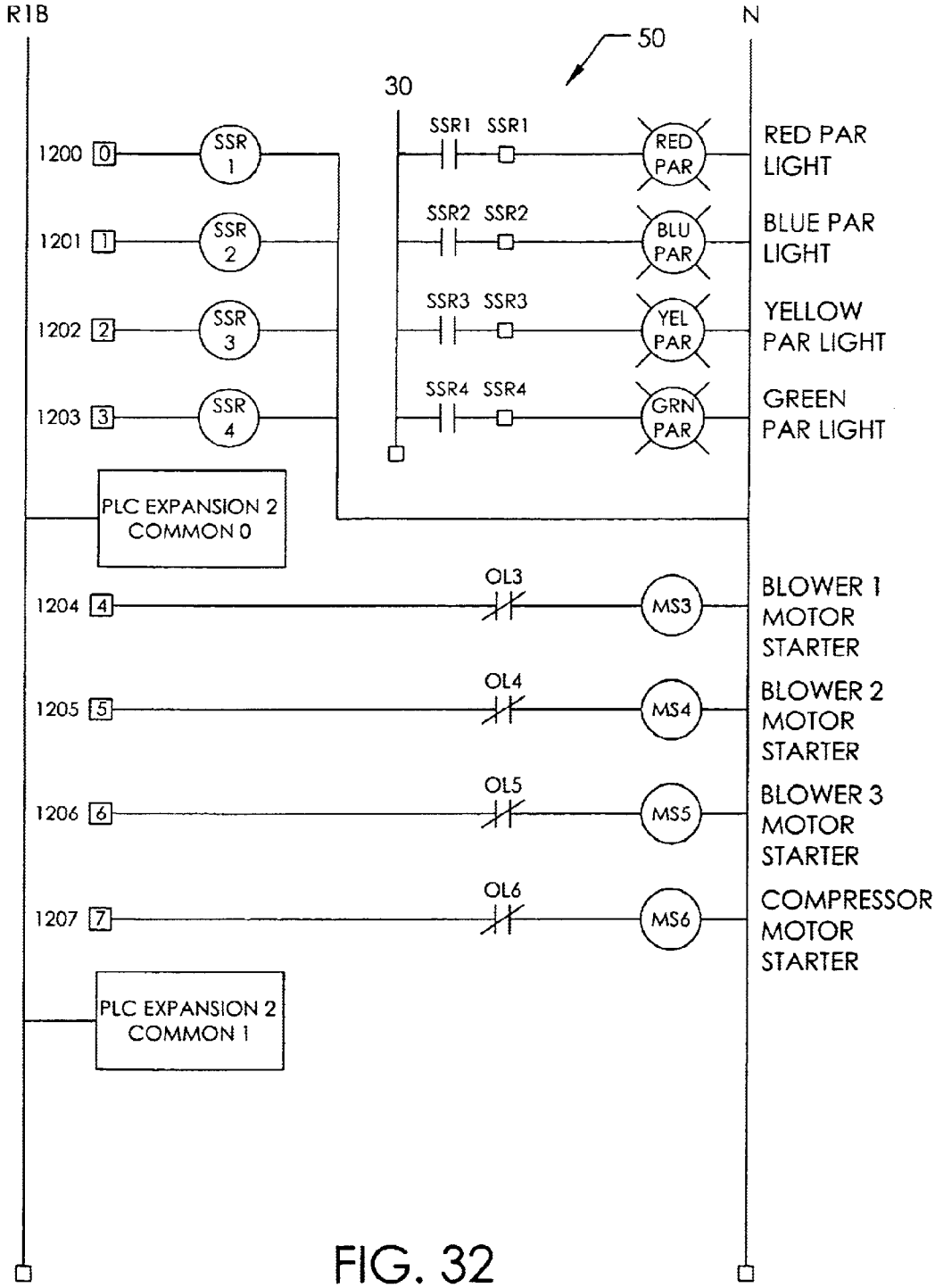
FIG. 32 shows a ninth portion of the electrical schematic for the integrated stuffing and fluffing machine which utilizes a programable logic controller.

Referring now to the drawings, there is shown in the figures stand alone embodiments of the fiber stuffing and fluffing machine showing the fluffer and stuffer and associated components and circuitry of the present art and integrated embodiments along with associated components and circuitry. The drawings show the fiber stuffing and fluffing machine 10 comprising in an embodiment a stuffing machine 12 having a stuffing nozzle 14, an agitation cavity 30, a control system 50, a pressurized air supply 56, and activation switches 158, 160, 162, 164, and a fluffing machine 64 having a housing 72 and blower 74, a plenum 78, and a blast gate valve 92. All of the aforementioned uniquely formed and combined with further described portions of the apparatus to provide the useful features herein described. An embodiment of the present art combines the stuffing machine 12, fluffing machine 64, and a compressed air source 56 into a single stand alone machine.

The invention first comprises a stuffing machine (stuffer) 12 having a stuffing nozzle 14, an agitation cavity 30 having access doors 40 and a filtered exhaust vent 44, rotating or moving agitator blades 48 within said cavity 30, a venturi 20 within said stuffing nozzle 14, along with the unique control and switching systems 50 described and shown herein. The invention also comprises a fluffing machine (fluffer) 64 which operates in conjunction with said stuffer 12 to blow stuffing fibers through a duct or pipe 68 into the agitation cavity 30 of said stuffer 12. Said fluffer 64 comprises a blower 74 mounted within a housing 72 which is fed stuffing fibers through a plenum 78 along with the unique control and switching systems 50 described herein. The fluffer 64 serves to expand or fluff the compressed fibers prior to entrance within the agitation cavity 30.

The present invention presumes availability of a compressed air source 56. In the preferred embodiment, said air source 56 is a uniquely compact air source heretofore not utilized for the present application arts and also integrally mounted within the stuffing machine. The preferred compact air source 56 is a scroll compressor, such as the Atlas Copco SF-4PP or equivalent. Said scroll compressor provides superior benefits for the present application. That is, it provides high pressure and high volume airflow in a compact package with a limited noise output. Another preferred compact air source 56 is a turbine compressor, such as model 1175001-12 from the Lamb Electric Division of Ametek, which heretofore has not been utilized in the prior art. The turbine compressor provides the desired high volume airflow in a compact package with a limited noise output, yet has a limited pressure output which requires the feed orifices within the aforementioned venturi be larger in order to accommodate the lower pressure. Traditionally a piston or screw type compressor is use with the prior art.

The stuffing nozzle 14 of the stuffer 12 has a entrance 17 and exiting 19 portion and connects the entrance 17 with the agitation cavity through the housing 15 of the stuffer 12. The present invention utilizes a stuffing nozzle venturi 20 system in conjunction with unique control and feeding methods which ensure that a vacuum or negative pressure exists at the portion of the stuffing nozzle 14 within or near the agitation cavity 30. The venturi 20 within the stuffing nozzle 14 suctions the stuffing fibers from the agitation cavity 30. Since a negative pressure exists where the fibers enter the stuffing nozzle 14, the stuffing fibers are not able to easily buildup. Any fibers which are agitatively placed near the entering portion 17 of the stuffing nozzle, i.e. the venturi 20 entrance, are suctioned into the stuffing nozzle 14 and thereafter into the venturi 20 entrance throat 21. The venturi 20 exiting throat 23 contains the compressed air stream which feeds the venturi 20. Thus, any fiber which enters the venturi entrance throat 21 is suctioned through the venturi 20 and then blown out of the venturi 20 exiting throat 23 by the compressed air which feeds the venturi 20. The compressed air venturi feed further serves to inflate the article at the exiting portion of the stuffing nozzle 19, thereby forming a cavity into which is deposited the stuffing fiber suctioned from the agitation cavity 30.

Another aspect of the present stuffer 12 invention in conjunction with the machine control as a whole is the orientation of the agitator blades 48 with respect to the entrance portion 17 of the stuffing nozzle 14. That is, in the preferred embodiment, the rotational axis of the agitator 46 is placed perpendicular to the entrance portion 17, 21 of the stuffing nozzle 14. This allows the agitator blades 48 to sweep closely past said entrance portion 17, 21 and act to clean and remove fibers from the entrance 17, 21. For alternative embodiments with more than one nozzle 14, the agitator blades 48 which sweep each nozzle entrance 17, 21 may be offset over a plurality of angles relative to each other and to the axis of rotation. For example, the blades 48 for a left nozzle 14 may be positioned 90 degrees offset from the blades 48 for the right nozzle 14. This provides a mixing or flip-flop effect for the stuffing fibers within the cavity 30.

A feature of the present invention in conjunction with the machine control as a whole is the utilization of an interlocked air pressurization system 52. That is, in a preferred embodiment, air pressurization to the venturi 20 system ceases when the agitator 46 drive system is turned off or a stuffing machine door 40 is opened for servicing or filling. This is accomplished by safety switches 42 located in each door 40 interrupting the energizing current to a normally closed electrically actuated air valve 43. The air valve 43 is in series with the pressurized air supply for the venturi 20. A display mode is also provided which disables the venturi 20 system. Through utilization of a display mode switch in series with an air valve 24, the venturi 20 and its electropneumatic air valve 24 are disabled yet the stuffing machine 12 continues agitating the fibers within the cavity 30 and also provides lighting and sound effects.

A unique feature of the present invention is the use of a hand actuated switch 160. An embodiment of the present art utilizes an extendable squeeze bulb 162 at hand level which pneumatically actuates an electric switch 160 which in turn then energizes and opens an electropneumatic valve 24 to activate venturi operation. The electropneumatic valve 24 is normally closed but when actuated allows compressed air to flow into and through the venturi 20. The aforementioned squeeze bulb 162 hand actuated switch 160 further provides an added margin of safety to the machine 12. That is, since it is a pneumatic switch the user is electrically isolated from the system. The invention also uses an electrical foot switch 158 in parallel with said squeeze bulb switch 160 which performs the aforementioned via foot movement action without extending pneumatic lines to said foot switch 158.

An embodiment of the present art incorporates a conductive paint 34 which coats the interior surface 31 of the agitation cavity 30 and allows excess charge to be bled or discharged onto or away from the surface of said cavity. The surface 31 of the cavity 30 is typically grounded to an earth ground. A further embodiment, incorporates an ionized air shower within the agitation cavity. The ionizers are commercially available components that mount within a compressed air flow line and negatively ionize the air flowing therethrough. Typically said ionizers operate with conventional 110 or 220 volt AC power but may be designed to operate on any AC or DC power source. A still further embodiment incorporates the use of an anti-static mat 38 within the agitation cavity 30. This mat 38 is held to earth ground and helps neutralize the positively charged fibers within the agitation cavity 30.

An embodiment of the present art utilizes a pulsed pneumatic feed to the venturi. This is accomplished via actuation of a pulsed timing circuit in series with the electropneumatic venturi valve 24 which provides a typically one to five hertz electric pulse actuation of the electropneumatic venturi valve 24. The pulsed timing circuit is actuated with a pulsed timing switch in a preferred embodiment but may actuate automatically or continuously in alternative embodiments. The pneumatic pulsing allows the agitator blades 48 to remove any accumulated fibers from the entrance 17 mouth of the nozzle 14 without negative venturi pressure holding said fibers in place and yet retain an air flow within the venturi nozzle 14 for any remnant fibers within said nozzle. Said pulse timing circuit is simply a low frequency oscillator which generates electrical driving pulses to said electropneumatic valve 24. The frequency of said pulses may deviate from said one to five hertz in alternative embodiments. That is, the frequency may be so low as to only pulse the venturi 20 air flow off occasionally or pulse the venturi 20 air flow off and on at hundreds or thousands of hertz. Further included within an embodiment of the present invention is an exiting nozzle 16 which is mounted upon an extension hose 18. This extension hose/nozzle combination allows the fiber stuffable item to be located apart from the vicinity of the agitation cavity 30 exiting nozzle 16. The art of the present invention further allows mounting of more than one stuffing nozzle 16 onto a machine with a single agitator 46. Alternative embodiments utilize a swivel or pivoting nozzle 16 design fed by said extension hose 18, or directly from the agitation cavity 30, which allows the operator to move the nozzle 16 to a convenient position. In this embodiment, typically said nozzle 16 is connected with the cavity 30 via said hose 18 with said venturi 20 positioned in-line with said hose 18 or nozzle 16.

For pivoting, said nozzle 16 is connected with a turret 26 which pivots on a turret mount 28. Said turret 26 further has a turret nipple 27 which exits said turret 26 substantially opposite said nozzle 16 and connects with said extension hose 18. Since said extension hose 18 is preferably flexible, said nipple 27 may pivot with said turret 26 if necessary. A further unique feature of the turret 26 is its ability to be locked in place with a locking clamp 29. The locking feature allows a user to maintain positioning of the nozzle 16 as desired. Alternative embodiments may provide said nozzle 16 swiveling feature in a plurality of ways including but not limited to use with or without a turret 26 and extension hose 18.

Use of a venturi 20 at the exiting end of an extension hose 18 also allows removal and stuffing of fibers or other material from an overhead holding receptacle. That is, if stuffing fibers or filling material are held in an overhead hopper, gravity hose feeding will allow the venturi to suction and direct said material under pressure to a receptacle.

The present art stuffing machine further utilizes an air filter at the exhaust vent 44 within the agitation cavity 30. The present art air filter, such as those commercially available for heating and air conditioning applications, over the exhaust vent 44 prevents escape of small fiber material. Typically said exhaust vent 44 and filter are located near the topmost portion of the agitation cavity 30.

Typically used with the aforesaid stuffing machine 12 is a fluffer machine 64 which is often called a picker within the prior art. The fluffer 64 takes compressed fiber stuffing material, fluffs it or agitates it, and then blows it into the stuffing machine 12 agitation cavity 30 through a pipe 68 or flexible hose. The fluffer 64 typically comprises a rotating blower 74 mounted within a housing 72 which provides the fluffing agitation and pressurization necessary to blow the fiber into the stuffing machine 12. Noise is alleviated by placing sound absorbing foam material within the fluffer housing 72, especially near the blower 74 and blower motor 76.

The present art fluffer 64 incorporates one or more unique diverting blast gate valves 92 at its output which allows switching among multiple stuffing machines 12 connected to a single fluffer 64. That is, when a stuffing machine 12 requires filling by the fluffer 64, a blast gate valve 92 may be openly positioned to direct the flow to the desired stuffing machine 12 and thereafter fill the agitation cavity 30 with the desired amount of stuffing fiber. In a preferred embodiment, the blast gate valve 92 is pneumatically opened and closed. Alternative embodiments may utilize manual, hydraulic, or electrical control.

The present art further provides an embodiment having an integrated stuffer 12 and fluffer 64 combination. That is, an embodiment of the present art places the stuffer 12 and fluffer 64 into a single stand alone machine also having an integrated air supply 56 and operating from a single power source and having a footprint less than 50 square feet. A preferred embodiment has a footprint of approximately 20 square feet. An alternate embodiment of the integrated stuffer-fluffer may utilize the blast gate valve 92 to feed stuffing material to a separate and stand alone stuffing machine 12, thereby eliminating the need for another stand alone fluffer 64. Furthermore, the duct or pipe 68 between the fluffer 64 and stuffer 12 may be diverted external to the machines and manufactured of a clear material, whether the machines are integrated or stand alone, to allow visualization of the fiber flow between the fluffing 64 and stuffing 12 machines.

The unique blast gate valve 92 design of the present art incorporates novel features which minimize buildup and clogging within said valve. The present art valve 92 utilizes a pneumatically operated blade 132, with a unique pneumatic cylinder 140 and alignment coupler 150 system. Within the present art, the blast gate valve blade 132 first end 134 is perfectly shaped to seat against a half circular seat 124 which follows the contours of the blast gate mid-section. The seat 124 is flush in a substantially half circle radius with the circular outline of the circular mid-section 130 whereby fibers cannot be trapped. Alternative embodiments may change the geometric shape of the seat 124 and blade 132 without departing from the scope of the present invention.

The preferred embodiment of the blast gate valve 92 comprises a valve body 94 having an entrance port 126 and an exiting port 128, and formed from a first 96 and second 106 PVC layer between which is sandwiched a specially shaped (preferably metallic) seat material 118, a valve blade 132, a pnuematic cylinder actuator 138 mounted onto said valve blade 132, an extension arm 146 extending from said pnuematic cylinder 140, and an alignment coupler 150 having a first end 152 attached to said extension arm 146 and a second end 154 attached to said valve body 94. Each PVC layer 96, 106 has a topside 98, 108 and a bottom side 102, 112 and is of substantially the same shape. Each PVC layer contains an opening or hole 100, 110 into which the pipe 68 may be mounted and preferably solvent bonded into place. In the preferred embodiment, the aforesaid hole 100, 110 has a lip 104, 114 around its circumference on the bottom side 102, 112 which limits the pipe 68 insertion depth therein. Alternative embodiments may manufacture the layers from materials other than the aforesaid, such as metals, composites, woods, plastics, or laminates and/or not utilize said lip 104, 114 without departing from the spirit and scope of the present invention.

The specially shaped (preferably metallic) seat material 118 has a void which forms a substantially "U" shaped plate 120 which is sandwiched between the bottom sides 102, 112 of each PVC layer and also serves as a spacer. The layers 96, 106 and seat 118 are typically held together with screws or bolts but other methods of attachment such as rivets, welds, adhesives, or clamps will also function. The distance between the legs 122 of the void or "U" shape is substantially equivalent to the diameter of the aforementioned lip 104, 114 or mid-section within the hole 100, 110 of the PVC layer mid-section. The "U" shaped seat 120 is uniquely designed at the base of the "U" to follow a half circular contour of the lip 104, 114 within the PVC layer holes 100, 110 mid-section and thereby form a seat for the valve blade 132. The "U" shaped seat 120 is further designed to allow the valve blade 132 first end 134 to fit within and uniquely conform to the void or interior of the "U" shape of the seat 118.

In a preferred embodiment, the valve blade 132 is of substantially similar thickness as said "U" shape 120 of said seat material 118 and slidingly operates within a blade gap 116 between said PVC layers 96, 106 which is formed by the interior of the "U" shaped seat 120 within the sandwich. That is, the seat material 118 serves as a uniquely shaped spacer between the layers. Alternative embodiments may utilize a blade 132 which is thinner than the seat material 118 thickness. The valve blade 132 is of substantially similar shape as the interior of the "U" and thereby sealingly mates on its first end with the seat material 118 when slided into a fully closed position.

The pneumatic cylinder 140 actuator 138 together with its extension arm 146 is commercially manufactured and in a preferred embodiment comprises an NCMB075-0600 by SMC Corporation. Alternative embodiments may incorporate other brands, models, or styles of cylinder actuators 138. In a preferred embodiment, a first bracket 148 is attached to said pnuematic cylinder 140 which further attaches to said valve blade 132 on or near a second end 136 opposite said first end 134. Said first bracket 148 is preferably attached with screws and/or nuts but may be attached by numerous methods such as pins, adhesives, welds, or frictional methods. The pneumatic cylinder actuator 138 preferably has two pneumatic ports 142, one for extension and one for retraction of the extension arm 146. Alternative embodiments may have only one pneumatic port and utilize a spring mechanism to retract or extend the extension arm. Further alternative embodiments may utilize hydraulic, gear drive, manual, or electromagnetic action in place of the pneumatic portion of the cylinder actuator 138.

The alignment coupler 150 is commercially manufactured and in a preferred embodiment comprises an NJ04 by SMC Corporation. Alternative embodiments may incorporate other brands, models, or styles of alignment couplers 150 or forego use completely. Said alignment coupler 150 provides a secure linear mating between said extension arm 146 and the valve body 94 within the extension arm 146 line of movement without binding if a lateral misalignment exists the second end of said alignment coupler is attached to said valve body with a second bracket 156. Said second bracket 156 is preferably attached with screws and nuts but may be attached by numerous methods such as pins, adhesives, welds, or frictional fits. The first 148 and second 156 brackets simply represent a method by which the pneumatic cylinder actuator 138 together with its extension arm 146 may be connected between the valve body 94 and the valve blade 132. Alternative embodiments may or may not utilize brackets or may utilize variations of the brackets disclosed herein.

In a preferred embodiment, the first end 152 of said alignment coupler 150 is threadedly attached to said extension arm 146. This threaded attachment allows the position of the blast gate blade 132 to be adjusted when in a closed position. That is, the closed position of the blast gate blade 132 should be positioned so as to not contact the half circular seat 124. Since the pneumatic cylinder 140 is self limiting in travel when retracted, i.e. limits the travel of the extension arm 146, the threaded attachment with the alignment coupler may be adjusted to ensure that the blast gate blade 132 does not contact the half circular seat 124 when in a closed position. This limiting positioning uniquely ensures that the blast gate blade 132 does not bottom out on the half circular seat 124 and thereby damaging the blast gate blade 132 or any of its mating portions.

In operation, when compressed air is placed onto a first port 142 of said pneumatic cylinder 140, the extension arm 146 retracts, thereby sliding and engaging the valve blade 132 within said "U" shape 120 of said valve seat 118 and further blocking the passage from the first PVC layer 96 to the second PVC layer 106. When compressed air is placed onto a second port 142 of said pneumatic cylinder 140 and the first port 140 is vented to atmosphere or has a lesser pressure applied, the extension arm 146 extends, thereby sliding and disengaging the valve blade 132 from the "U" shape 120 of said valve seat 118 and further opening the passage from the first PVC layer 96 to the second PVC layer 106.

The foreign object ingestion problem is eliminated in an embodiment of the present art via the use of a feed separation plenum 78 at the entrance to the fluffer 64. The feed separation plenum 78 may have various forms and may function with a stand alone fluffer 64 or an integrated fluffer-stuffer combination. In a preferred embodiment, the feed separation plenum 78 is a vertical cavity 84 having a fiber entrance opening 86 at a higher level and a fiber exiting opening 88 below said entrance but nevertheless, at a higher level than the internal base 90 of said cavity. The plenum fiber exiting opening 88 is connected via piping or hoses with the fluffer 66 entrance. Foreign objects of higher density than the stuffing fiber are more affected by gravitational pull within the vertical cavity 84 than the suction of the fluffer 64. Thus stuffing fiber is pulled into the fluffer 64 while foreign objects of higher density fall to the base 90 of the plenum cavity 84, thereby protecting the fluffer 64 from damage.

An alternative plenum design places the fiber exiting opening 88 above the entrance 86 to the plenum 78. The entrance 86 and fiber feed to the plenum 78 is near its base 90 and the suction from the blower 74 within the fluffer 64 pulls the fibers vertically into and through the plenum 78 against the force of gravity. Any foreign objects which are of higher density than the fluffing material are not suctioned through the plenum 78 due to insufficient suction airflow against the gravitational effect on said foreign objects. In an embodiment of the integrated stuffer-fluffer, said plenum 78 comprises a vertical tube of approximately eight inches diameter which suctions fibers from a lower open portion or fiber entrance opening 86 to a higher fiber exiting portion 88 which is mated with the entrance 66 or intake to the integrated fluffer 64. Heavier objects which may damage the fluffer 64, cannot be suctioned vertically into the fluffer 64, thereby falling to the floor. In an embodiment said plenum 78 is visually clear to allow for monitoring of the fiber intake.

An alternative embodiment of the fluffer 64 further utilizes a deflector system in the form of a deflector plate 91 at the output of the fluffer blower 74 to partially recirculate stuffing fibers through a duct or pipe into the entrance, input, or intake of the fluffer blower 74 or to restrict output fiber flow whereby fibers are retained for a longer period within said fluffer blower 74. Since the integrated fluffer 64 is positioned on or with said stuffer 12, the length of duct or piping between the fluffer 64 and stuffer 12 is minimal or not present. This reduced length tends to limit the turbulent mixing of the fluffed fibers and the surrounding air flow. Thus, by recirculating a portion of the stuffing fibers with the deflector plate 91 deflecting the fibers back into the entrance 66, intake, or impeller of the fluffer 64, greater fluffing and/or shredding of the fibers is achieved. The deflector plate 91 and associated ducting is useful for both integrated and non-integrated fluffing machines. Alternative embodiments may implement said deflector system via simply placing a duct or pipe from an output portion the fluffer blower 74 to an input or intake portion of said fluffer blower 74.

Alternative embodiments of the present art further incorporate integrated sound such as recorded music or unique noises or sounds which are played in response to a user input. Such inputs include but are not limited to button pressing, motion detector sensing, pressure mat sensing, conductive sensor sensing of a user, or radio frequency identification of user's radio frequency identification tag. The integrated sound is enable via an on board computer or electronic circuit connected with said sensors and which have the music or sound stored within and further drive connected speakers. Thus, when the aforementioned sensors activate, the computer or microcircuit is triggered to play the unique sound, thereby making the stuffing experience more enticing and interesting.

Further alternative embodiments of the present art incorporate one or more colored lighting sources to illuminate the agitation cavity 30 or the machine as a whole. Since the stuffing fiber material which is typically utilized with the present art is of a bright white color, colored lighting shining onto the fibers tends to impart the lighting hue or color to the fiber. This colored effect produces a glowing of the agitating fibers which is attractive and pleasant to the user, thereby enticing the user to utilize the stuffing machine 12. The colored lighting is automatically sequenced by electronic circuitry of the machine or may be triggered by the same type sensors as described for the aforementioned sound effects. The lighting may be enabled with a plurality of technologies including but not limited to incandescent, flourescent, neon, or light emitting diode sources. The lighting may also utilize gels or colored filters between the light source and the light target to provide further control of the impinging hue.

Further alternative embodiments utilize a scrolling text or panel display mounted with or onto the machine 12, 64. The display may provide rolling messages for the user such as "happy birthday" or a company name when activated. The display may also provide animations, cartoons, or customer information to further encourage use of the machine. The aforesaid may be embodied in the form of a computer or video display machine which drives the display and is activated with the aforementioned sensors or automatically due to a user input or machine energizing or sequencing.

Still further alternative embodiments utilize one or more electronic cameras mounted onto or near the machine 12, 64 to capture customer images. Said images may be displayed upon the aforesaid displays or printed to capture the moment. The electronic camera functions are enabled via use of a computer or electronic circuit interfaced with said electronic cameras and said display or an attached printer. Thus, customers are further encouraged to use the machine by the ability of the machine to capture the moment of toy stuffing.

Further alternative embodiments utilize an integrated blowing or cleaning head having a pneumatic inlet and outlet and mounted with or onto the machine 10. This integrated blowing or cleaning head is connected with the pressurized air supply 56 and supplies an air shower from its output for cleaning external remnant fibers from the stuffed toy, pillow, or skin. The head has a valve integrated with it or is connected with a valve which is connected to said pressurized air supply 56. When the article is filled with fibers, the user places the article under the air shower to remove any externally remaining stuffing fibers.

In summary, the art of the present invention comprises in one or more of its forms a unique stuffing machine 12 having an agitation cavity 30, a motor operated agitator 46, one or more agitator blades 48, one or more stuffing nozzles 14 communicating externally from said cavity 30, a pneumatically operated venturi 20 within said stuffing nozzle 14, an air bulb switch 162 and electrical foot switch 158 for actuation of said venturi 20, a fluffing machine 64 having a blower 74 and blower motor 76, a fluffer plenum 78 attached to its input 66, a static control system 32 and the other aforementioned features.

In operation, the user first directs the fluffer blast gate valve 92 to feed the stuffing machine 12 desired, if a blast gate is utilized. The user then feeds stuffing fiber material into the fluffer plenum 78 entrance 86 which is then suctioned through the plenum 78, into the fluffer 64, and then blown under pressure into the desired stuffing machine 12. Once fed with stuffing fiber, the stuffing machine 12 is ready for operation. The user may then place an item for stuffing onto the output of the stuffing nozzle 14 and energize the venturi 20 within said nozzle 14. The venturi 20 suctions stuffing fiber material from the agitation cavity 30, pressurizes the stuffable item, and then blows the stuffing fiber into the stuffable item. Once filled, the user de-energizes the venturi 20 and seals the stuffed item containing the stuffing fibers. When the stuffing fibers within the agitation cavity 30 are depleted, the user re-feeds more stuffing fiber from the fluffer 64.

The electrical schematic of a fluffer embodiment described herein is shown in the figures. The circuit comprises a preferably three phase 208 volt power source which drives a blower motor 76 through a three phase contactor MS1 166 having an overload protector. A stepdown transformer, XFR1, 172 has a primary which taps two phases of the three phase power to generate a secondary potential at or near 115 volts ac which is used for the electropneumatic valves 24, 43 and the contactor control. Said 115 vac potential connects with the contactor energizing coil 168 through the start switch, stop switch, and door safety switch 42. If the fluffer door 40 is open, thereby opening the safety switch 42, the three phase contactor 166 cannot close and energize the blower motor 76 on the fluffer 64. If the start switch is not pressed or if the stop switch is pressed, the three phase contactor 166 also cannot close. Across the start switch contacts is an auxiliary contact 170 from said MS1 contactor. This auxiliary contact 170 closes when the contactor MS1 166 is energized and shunts the start switch, thereby keeping the fluffer 64 operating until the stop switch or door safety switch 42 contacts are opened. Said 115 vac potential further connects with each electropneumatic valve 24,43 through a separate switch for each. When an electropneumatic valve 24, 43 switch is engaged, the electropneumatic valve 24, 43 opens and allows air pressure to enter the pnuematic cylinder actuator 140, thereby opening or closing the blast gate valve 92 as desired.

The electrical schematic of a stuffer 12 embodiment described herein is shown in the figures. The circuit again comprises a preferably three phase 208 volt power source which drives an agitator motor through a three phase contactor MS1 174 having an overload protector. A stepdown transformer, XFR1, 180 also has a primary which taps two phases of the three phase power to generate a secondary potential at or near 115 volts ac which is used for the electropneumatic valves 24, 43 and the contactor control. Said 115 vac potential connects in series with the contactor energizing coil 176 through the start switch, stop switch, off-run switch and a door safety contactor, CR1-A. Across the start switch contacts is an auxiliary contact 178 from said MS1 contactor. This auxiliary contact 178 closes when the contactor MS1 174 is energized and shunts the start switch, thereby keeping the stuffer operating until the stop switch, off-run switch, or door safety switch contactor is opened. A second step down transformer, XFR2, 182 has a primary which is attached across said 115 vac potential to provide an approximately 24 volt ac secondary source for the series circuit of the right and left door safety switches 42 and energizing coil for the door safety contactor CR1. That is, since the door safety switches 42 are placed near the operator, it is desirable to minimize the potential present for safety concerns. Thus, if all of the stuffer doors 40 are closed, the safety switches 42 are closed and the door safety contactor closes thereby allowing the stuffer agitator motor and electropneumatic valves to operate. If the start switch is not pressed or if the stop switch is pressed, the three phase contactor 174 also cannot close. In series with the electropneumatic valves 24 is an electrical foot switch 158 and hand actuated air switch 160, 164, said switches are in parallel. When either of the aforementioned switches closes, an electropneumatic valve solenoid is energized and the electropneumatic valve 24 opens and allows air pressure to enter the venturi 20 and perform the stuffing operation.

The fluffer 64 and stuffer 12 may utilize power of different potential, single or three phase, without departing from the scope and spirit of the present invention, provided the motors, valves, and contactors are sized and specified for such power. Furthermore, the schematic representations provided herewith may be substantially altered and yet provide the same external functions described.

From the foregoing description, those skilled in the art will appreciate that all objects of the present invention are realized. An improved fiber stuffing and fluffing machine for stuffing toys, pillows, skins, and the like is shown and described as an improvement to the present art. The machine is particularly adapted for quick and easy stuffing of the aforesaid and for placement at retail locations where physical space is limited. No claim is made to the venturi, the blade orientation, interlock system, first fluffer plenum (not including the alternative embodiments of the fluffer plenum), or a generic or prior art pneumatic blast gate in conjunction with a fluffer (not including the unique blast gate with its unique seat feature described herein) apart from one or more of the other features listed and described.

Having described the invention in detail, those skilled in the art will appreciate that modifications may be made to the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. A fiber stuffing and fluffing machine capable of stuffing fibers into a skin comprising:

a fiber stuffing machine having a stuffer housing, a stuffing nozzle having an entrance portion and an exiting portion, an agitation cavity having an interior surface, an agitator having one or more agitator blades within said agitation cavity, and a venturi connected with said stuffing nozzle whereby stuffing fibers within said cavity are suctioned into said nozzle via the action of said venturi and thereafter discharged from said nozzle; and a fiber fluffing machine having a fluffer housing, a fluffer entrance, a fluffer output feeding into said agitation cavity and a blower having a blower input connected with said fluffer entrance and a blower output connected with said fluffer output and capable of providing a suction at said fluffer entrance and discharging stuffing fibers from said fluffer output; and a pressurized air supply capable of supplying compressed air to said venturi.

2. The fiber stuffing and fluffing machine as set forth in claim 1 whereby:

said fluffer housing and said stuffer housing are a single housing, whereby said single housing houses both said stuffing machine and said fluffing machine.

3. The fiber stuffing and fluffing machine as set forth in claim 2 whereby:

said pressurized air supply is housed by said single housing.

4. The fiber stuffing and fluffing machine as set forth in claim 3 whereby:

said pressurized air supply is a turbine compressor.

5. The fiber stuffing and fluffing machine as set forth in claim 3 whereby:

said pressurized air supply is a scroll compressor.

6. The fiber stuffing and fluffing machine as set forth in claim 1 whereby:

said pressurized air supply is a turbine compressor.

7. The fiber stuffing and fluffing machine as set forth in claim 1 whereby:

said pressurized air supply is a scroll compressor.

8. The fiber stuffing and fluffing machine as set forth in claim 1 whereby said fluffing machine further comprises:

a feed separation plenum, said plenum having a fiber entrance opening and a fiber exiting opening, said fiber exiting opening connected with said fluffer entrance and said fiber entrance opening of sufficient size to allow stuffing fibers to enter, whereby said plenum substantially separates objects of higher density from said fibers.

9. The fiber stuffing and fluffing machine as set forth in claim 8 whereby said feed separation plenum further comprises:

a vertical cavity between said fiber entrance opening and said fiber exiting opening.

10. The fiber stuffing and fluffing machine as set forth in claim 1 whereby:

said agitator blades orientated substantially perpendicular to the entrance portion of the stuffing nozzle, whereby said agitator blades sweep closely past said entrance portion and remove fibers from said entrance portion.

11. The fiber stuffing and fluffing machine as set forth in claim 1 further comprising:

a static control system whereby static charge buildup on said stuffing fibers is substantially eliminated.

12. The fiber stuffing and fluffing machine as set forth in claim 11 whereby said static control system comprises:

a conductive paint placed on a portion of said interior surface of said agitation cavity.

13. The fiber stuffing and fluffing machine as set forth in claim 11 whereby said static control system comprises:

an anti-static mat placed within said agitation cavity.

14. The fiber stuffing and fluffing machine as set forth in claim 11 whereby said static control system comprises:

an ionized air shower impinging upon said stuffing fibers.

15. The fiber stuffing and fluffing machine as set forth in claim 1 further comprising:

one or more colored lighting sources capable of illuminating stuffing fibers within the agitation cavity, whereby said lighting visually imparts a color to the fibers.

16. The fiber stuffing and fluffing machine as set forth in claim 1 whereby:

said stuffing nozzle swivels thereby allowing a user to position said nozzle for convenient use.

17. The fiber stuffing and fluffing machine as set forth in claim 1 further comprising:

a blast gate valve having a valve body, said valve body having an entrance port, an exiting port and a mid-section between said ports; and a valve blade having a first end and a second end and slidably positioned with said valve body and between said entrance and exiting ports; and and a seat for said valve blade conforming substantially flush with said mid-section, said seat substantially following the contour of said first end of said valve blade, whereby when said blade is seated with said seat fiber trapping is minimized.

18. The fiber stuffing and fluffing machine as set forth in claim 17 further comprising:

an actuator attached between said valve body and said valve blade whereby said actuator slides said valve blade from a seated position to an open position.

19. The fiber stuffing and fluffing machine as set forth in claim 18 whereby said actuator comprises:

a pneumatic cylinder having one or more pneumatic ports.

20. The fiber stuffing and fluffing machine as set forth in claim 19 further comprising:

an alignment coupler attached with said pneumatic cylinder, whereby binding of said pneumatic cylinder and said valve blade is minimized.

21. A blast gate valve comprising:

a valve body, said valve body having a first layer, said first layer having a topside and a bottom side and an opening from said topside to said bottom side; and said valve body having a second layer having a topside and a bottom side and an opening from said topside to said bottom side; and a seat material having a void and positioned between said bottom sides of said layers, thereby forming a blade gap, said void having an end substantially conforming to a portion of said openings of said bottom sides of said layers; and a valve blade having a first end and a second end and shaped to slidably fit substantially with said void of said seat material, said first end substantially conforming to said end of said void; and an actuator attached with one or more alignment couplers; and said actuator and one or more alignment couplers connected between a first bracket attached near said second end of said valve blade and a second bracket attached with said valve body, whereby said actuator is capable of placing sufficient force upon said valve blade to move said valve blade within said blade gap without binding.

22. The blast gate valve as set forth in claim 21 whereby:

said actuator comprises a pnuematic cylinder having one or more pneumatic ports and one or more extension arms.

23. The fiber stuffing and fluffing machine as set forth in claim 1 further comprising:

a deflector system positioned near the output of said fluffer blower, said deflector system capable of partially recirculating stuffing fibers through an impeller of said fluffer blower, whereby said fibers are further fluffed or shredded.

24. The fiber stuffing and fluffing machine as set forth in claim 23 whereby:

said deflector system comprises a deflector plate mounted near an output portion of said fluffer blower whereby said deflector plate causes stuffing fibers to recirculate with said impeller.

25. The fiber stuffing and fluffing machine as set forth in claim 1 further comprising:

a hand actuated squeeze bulb switch connected with a control and switching system, whereby squeezing of said squeeze bulb activates said venturi.

26. The fiber stuffing and fluffing machine as set forth in claim 1 further comprising:

an integrated sound system capable of producing sounds or music in reaction to a trigger provided by a user.

27. The fiber stuffing and fluffing machine as set forth in claim 1 further comprising:

one or more colored lighting sources shining onto said agitation cavity and capable of imparting a color to stuffing fibers contained within said agitation cavity.

28. The fiber stuffing and fluffing machine as set forth in claim 1 further comprising:

an integrated display capable of displaying messages or animations.

29. The fiber stuffing and fluffing machine as set forth in claim 1 further comprising:

an electronic camera mounted onto or near the machine whereby images may be captured.

30. The fiber stuffing and fluffing machine as set forth in claim 1 further comprising:

a display mode controlled by a control system which de-energizes the venturi and allows the agitator to perform agitation, thereby creating a visually attractive display.

31. The fiber stuffing and fluffing machine as set forth in claim 1 whereby:

said agitator blades are offset on a right side of said agitator relative to a left side of said agitator, whereby a mixing or flip-flop effect is provided.

32. The fiber stuffing and fluffing machine as set forth in claim 17 further comprising: said valve body having a first layer, said first layer having a top side and a bottom side; and said valve body having a second layer having a topside and a bottom side and an opening from said topside to said bottom side; and said seat having a seat material having a void and positioned between said bottom sides of said layers, thereby forming a blade gap, said void having an end substantially conforming to a portion of said openings of said bottom sides of said layers; and said valve blade shaped to slidably fit substantially with said void of said seat material, said first end substantially conforming to said end of said void; and an actuator attached with one or more alignment couplers; and said actuator and one or more alignment couplers connected between a first bracket attached near said second end of said valve blade and a second bracket attached with said valve body, whereby said actuator is capable of placing sufficient force upon said valve blade to move said valve blade within said blade gap without binding.

33. The fiber stuffing and fluffing machine as set forth in claim 1 whereby:

said fluffer housing and said stuffer housing are co-located together whereby said stuffing machine and said fluffing machine form a single integrated machine.

34. The fiber stuffing and fluffing machine set forth in claim 33 whereby:

said pressurized air supply is located within one or more of said housings.

35. The fiber stuffing and fluffing machine as set forth in claim 34 whereby:

said pressurized air supply is a turbine compressor.

36. The fiber stuffing and fluffing machine as set forth in claim 34 whereby:

said pressurized air supply is a scroll compressor.

37. A fiber stuffing and fluffing machine capable of stuffing fibers into a skin comprising:

a fiber stuffing machine, a fiber fluffing machine, and a pressurized air supply mounted within a single housing;

said stuffing machine having a stuffing nozzle having an entrance portion and an exiting portion; and a venturi having an entrance throat and an exiting throat connected with said entrance portion of said nozzle; and an agitation cavity having an interior surface and an agitator having one or more agitator blades positioned to substantially sweep closely past said entrance throat whereby stuffing fibers within said agitation cavity are agitated, kept fluffed, and cleaned from said entrance throat by said agitator blades; and whereby said venturi suctions stuffing fibers into said entrance throat of said venturi and thereafter blows stuffing fibers from said nozzle exiting portion; and said fiber fluffing machine having a fluffer entrance and a fluffer output feeding through a duct into said agitation cavity; and a plenum having a vertical cavity, a fiber entrance opening at a first end of said cavity, a fiber exiting opening at a second end of said cavity, said fiber exiting opening connected with said fluffer entrance; and a blower having a blower input connected with said fluffer entrance and a blower output connected with said fluffer output, said blower capable of providing a suction at said fiber entrance opening of said plenum which is capable of suctioning stuffing fibers but not capable of suctioning objects having a density greater than the density of the stuffing fibers through said vertical cavity, said blower further capable of discharging stuffing fibers from said fluffer output.

38. The fiber stuffing and fluffing machine as set forth in claim 37 further comprising:

a deflector system positioned near the output of said fluffer blower, said deflector system capable of partially recirculating stuffing fibers through an impeller of said fluffer blower, whereby said fibers are further fluffed or shredded.

39. The fiber stuffing and fluffing machine as set forth in claim 38 whereby:

said deflector system comprises a deflector plate mounted near an output portion of said fluffer blower whereby said deflector plate causes stuffing fibers to recirculate with said impeller.

40. The fiber stuffing and fluffing machine as set forth in claim 9 whereby said feed separation plenum further comprises:

said fiber entrance opening is at a lower level than said fiber exiting opening.

41. A fiber stuffing and fluffing machine capable of stuffing fibers into a skin comprising:

a fiber stuffing machine having a stuffer housing, a stuffing nozzle having an entrance portion having a gap and an exiting portion, an agitation cavity having an interior surface, an agitator having one or more agitator blades within said agitation cavity, and a compressed air stream flowing through said gap in said stuffing nozzle whereby stuffing fibers within said cavity fall into said gap and thereafter are discharged from said nozzle; and a fiber fluffing machine having a fluffer housing, a fluffer entrance, a fluffer output feeding into said agitation cavity and a blower having a blower input connected with said fluffer entrance and a blower output connected with said fluffer output and capable of providing a suction at said fluffer entrance and discharging stuffing fibers from said fluffer output; and a feed separation plenum comprising a substantially vertical cavity, said plenum having a fiber entrance opening and a fiber exiting opening, said fiber exiting opening connected with said fluffer entrance and said fiber entrance opening at a lower level than said fiber exiting opening and of sufficient size to allow stuffing fibers to enter, whereby said plenum substantially separates objects of higher density from said fibers; and a pressurized air supply capable of supplying compressed air to said compressed air stream.

42. A fiber fluffing machine capable of fluffing fibers comprising:

a fiber fluffing machine having a fluffer housing, a fluffer entrance, a fluffer output, a blower having a blower input connected with said fluffer entrance and a blower output connected with said fluffer output and capable of providing a suction at said fluffer entrance and discharging stuffing fibers from said fluffer output; and a feed separation plenum comprising a substantially vertical cavity, said plenum having a fiber entrance opening and a fiber exiting opening, said fiber exiting opening connected with said fluffer entrance and said fiber entrance opening at a lower level than said fiber exiting opening and of sufficient size to allow stuffing fibers to enter, whereby said plenum substantially separates objects of higher density from said fibers; and a pressurized air supply capable of supplying compressed air to said compressed air stream.

* * * * *